US012268273B2

(12) United States Patent
Iuchi et al.

(10) Patent No.: US 12,268,273 B2
(45) Date of Patent: Apr. 8, 2025

(54) SHOE SOLE

(71) Applicant: Shimano Inc., Osaka (JP)

(72) Inventors: Kadunori Iuchi, Osaka (JP); Junichi Kikuta, Osaka (JP); Toshiaki Aoki, Osaka (JP)

(73) Assignee: Shimano Inc., Osaka (JP)

( * ) Notice: Subject to any disclaimer, the term of this patent is extended or adjusted under 35 U.S.C. 154(b) by 44 days.

(21) Appl. No.: 18/112,273

(22) Filed: Feb. 21, 2023

(65) Prior Publication Data

US 2024/0277110 A1 Aug. 22, 2024

(51) Int. Cl.

| | |
|---|---|
| ***A43B 13/18*** | (2006.01) |
| ***A43B 13/02*** | (2022.01) |
| ***A43B 13/12*** | (2006.01) |
| ***A43B 13/14*** | (2006.01) |

(52) U.S. Cl.

CPC ..... *A43B 13/023* (2013.01); *A43B 13/127* (2013.01); *A43B 13/141* (2013.01); *A43B 13/183* (2013.01); *A43B 13/186* (2013.01); *A43B 13/026* (2013.01)

(58) Field of Classification Search

CPC ..... A43B 13/026; A43B 13/127; A43B 13/18; A43B 13/181; A43B 13/183

See application file for complete search history.

(56) References Cited

U.S. PATENT DOCUMENTS

| | | | | |
|---|---|---|---|---|
| 1,088,328 | A * | 2/1914 | Cucinotta | A43B 13/182 D2/947 |
| 4,492,046 | A * | 1/1985 | Kosova | A43B 13/183 36/38 |
| 4,566,206 | A * | 1/1986 | Weber | A43B 13/183 36/38 |
| 5,381,608 | A * | 1/1995 | Claveria | A43B 13/183 36/35 R |
| 5,528,842 | A * | 6/1996 | Ricci | A43B 21/30 36/38 |
| 6,928,756 | B1 * | 8/2005 | Haynes | A43B 13/183 36/38 |
| 7,100,308 | B2 * | 9/2006 | Aveni | A43B 13/12 36/144 |
| 10,945,489 | B2 * | 3/2021 | Conrad | A43B 13/186 |
| 2005/0108897 | A1 * | 5/2005 | Aveni | A43B 13/187 36/27 |
| 2022/0104581 | A1 | 4/2022 | Sakaguchi et al. | |
| 2022/0125158 | A1 | 4/2022 | Ni et al. | |

FOREIGN PATENT DOCUMENTS

JP 2017-64246 A 4/2017

* cited by examiner

*Primary Examiner* — Ted Kavanaugh

(74) *Attorney, Agent, or Firm* — Global IP Counselors, LLP

(57) ABSTRACT

A shoe sole is basically provided with a first layer and a second layer. The second layer is coupled to the first layer. The second layer has a forefoot part and a tarsal part. The forefoot part extends along the first layer and the tarsal part is configured to be displaceable relative to the first layer.

17 Claims, 24 Drawing Sheets

SHOE SOLE

BACKGROUND

Technical Field

This disclosure generally relates to a shoe sole for a shoe, and a shoe provided with the shoe sole.

Background Information

Generally, most shoes have an upper and a sole. The upper is stitched or adhesively bonded to the sole to form an interior foot receiving space for securely receiving a foot. The upper is typically formed from one or more flexible materials such as a textile fabric, a leather, and/or a synthetic leather that are stitched or adhesively bonded together. The upper can also include rigid reinforcements as needed and/or desired. The upper defines an ankle opening for inserting the wearer's foot into the interior foot receiving space and for removing wearer's foot from the interior foot receiving space. In addition, the upper can include a lace or other closure to more securely retain the shoe to the wearer's foot within the interior foot receiving space. The sole can be a single layer made of a suitable material, or can be made of several layers of different materials. In the case of many athletic shoes, the sole generally has an insole, a midsole and an outsole. The insole can define the bottom surface of the interior foot receiving space. The insole may be a thin compressible member that enhances the comfort of the shoe. The midsole is typically attached to the lower edge of the upper. The midsole is often a middle layer of the sole. The outsole is typically secured to a lower surface of the midsole, and forms a ground-contacting portion of the shoe.

SUMMARY

Generally, the present disclosure is directed to various features of a shoe sole that can increase that improves flexibility while maintaining sole rigidity during activities such as pedaling. Conventional cycling shoes typically have hard soles to increase rigidity so that energy loss during pedaling can be reduced. However, the hard soles of the shoes hinder flexion when walking. Thus, walking in shoes with hard soles can be uncomfortable.

In view of the state of the known technology and in accordance with a first aspect of the present disclosure, a shoe sole is provided that basically comprises a first layer and a second layer. The second layer is coupled to the first layer. The second layer has a forefoot part and a tarsal part. The forefoot part extends along the first layer and the tarsal part is configured to be displaceable relative to the first layer.

With the shoe sole according to the first aspect, it is possible to provide a shoe sole that can appropriately bend when walking and maintain sufficient rigidity in the forefoot part when performing other activities such as pedaling.

In accordance with a second aspect of the present disclosure, the shoe sole according to the first aspect is configured so that the second layer is more rigid than the first layer.

With the shoe sole according to the second aspect, the first layer can make the sole more comfortable to the wearer.

In accordance with a third aspect of the present disclosure, the shoe sole according to the first aspect or second aspect is configured so that the forefoot part is bonded to the first layer.

With the shoe sole according to the third aspect, the first layer is prevented from moving relative to the second layer in region of the forefoot part of the second layer.

In accordance with a fourth aspect of the present disclosure, the shoe sole according to any one of the first aspect to the third aspect is configured so that the second layer has a longitudinal direction extending between the forefoot part and the tarsal part, and a width direction perpendicular to the longitudinal direction. The forefoot part is wider than the tarsal part in the width direction.

With the shoe sole according to the fourth aspect, the rigidity in the forefoot part can be provided over a large area in the width direction than in the tarsal part.

In accordance with a fifth aspect of the present disclosure, the shoe sole according to any one of the first aspect to the fourth aspect is configured so that the second layer has a longitudinal direction extending between the forefoot part and the tarsal part. The second layer is shorter than the first layer in the longitudinal direction.

With the shoe sole according to the fifth aspect, cushioning in the heel area of the sole can be increased.

In accordance with a sixth aspect of the present disclosure, the shoe sole according to any one of the first aspect to the fifth aspect is configured so that the first layer includes a space, and the tarsal part is configured to be displaceable relative to the first layer into the space in the first layer in a state where the first layer is flexed.

With the shoe sole according to the sixth aspect, the shoe sole can reliably bend when walking.

In accordance with a seventh aspect of the present disclosure, the shoe sole according to any one of the first aspect to the sixth aspect further comprises a third layer being coupled to the forefoot part and having a ground contact surface.

With the shoe sole according to the seventh aspect, the shoe sole can be provided with an appropriate traction.

In accordance with an eighth aspect of the present disclosure, the shoe sole according to any one of the first aspect to the seventh aspect is configured so that the first layer includes a foam material.

With the shoe sole according to the eighth aspect, the first layer can reliably provide an appropriate amount of cushioning to the shoe sole.

In accordance with a ninth aspect of the present disclosure, the shoe sole according to the eighth aspect is configured so that the foam material includes an ethylene-vinyl acetate foam.

With the shoe sole according to the ninth aspect, the first layer can reliably provide an appropriate amount of cushioning to the shoe sole.

In accordance with a tenth aspect of the present disclosure, the shoe sole according to the eighth aspect or the ninth aspect is configured so that the foam material includes a polyurethane foam.

With the shoe sole according to the tenth aspect, the first layer can reliably provide an appropriate amount of cushioning to the shoe sole.

In accordance with an eleventh aspect of the present disclosure, the shoe sole according to any one of the first aspect to the tenth aspect is configured so that the second layer includes a resin material.

With the shoe sole according to the eleventh aspect, the second layer reliably provide an appropriate amount of rigidity to the shoe sole.

In accordance with a twelfth aspect of the present disclosure, the shoe sole according to the eleventh aspect is configured so that the resin material includes a polyamide material.

With the shoe sole according to the twelfth aspect, the second layer reliably provide an appropriate amount of rigidity to the shoe sole.

In accordance with a thirteenth aspect of the present disclosure, the shoe sole according to the eleventh aspect or the twelfth aspect is configured so that the resin material includes a fiber material.

With the shoe sole according to the thirteenth aspect, the strength of the second layer can be improved while minimizing an increase in the weight of the shoe sole.

In accordance with a fourteenth aspect of the present disclosure, the shoe sole according to the thirteenth aspect is configured so that the fiber material includes a plurality of carbon fibers.

With the shoe sole according to the fourteenth aspect, the strength of the second layer can be improved while minimizing an increase in the weight of the sole.

In accordance with a fifteenth aspect of the present disclosure, the shoe sole according to the thirteenth aspect or the fourteenth aspect is configured so that the fiber material include a plurality of glass fibers.

With the shoe sole according to the fifteenth aspect, the strength of the second layer can be improved while minimizing an increase in the weight of the shoe sole.

In accordance with a sixteenth aspect of the present disclosure, the shoe sole according to any one of the first aspect to the fifteenth aspect is configured so that the second layer includes at least one first protrusion disposed on one of the forefoot part and the tarsal part.

With the shoe sole according to the sixteenth aspect, the rigidity of the second layer can be reliably increased while minimizing an increase in the weight of the shoe sole.

In accordance with a seventeenth aspect of the present disclosure, the shoe sole according to sixteenth aspect is configured so that the second layer includes at least one second protrusion disposed on the other one of the forefoot part and the tarsal part.

With the shoe sole according to the seventeenth aspect, the rigidity of the second layer can be reliably increased while minimizing an increase in the weight of the shoe sole.

In accordance with an eighteenth aspect of the present disclosure, the shoe sole according to the seventeenth aspect is configured so that the second layer has a longitudinal direction extending between the forefoot part and the tarsal part, and the first protrusion and the second protrusion extend in the longitudinal direction.

With the shoe sole according to the eighteenth aspect, the rigidity of the second layer can be reliably increased while minimizing an increase in the weight of the shoe sole.

In accordance with a nineteenth aspect of the present disclosure, a shoe comprises the shoe sole according to any one of the first aspect to the nineteenth aspect, and further comprises an upper coupled to the shoe sole.

With the shoe sole according to the nineteenth aspect, it is possible to provide a shoe that can appropriately bend while walking and maintain sufficient rigidity while pedaling.

Also, other objects, features, aspects and advantages of the disclosed shoe sole will become apparent to those skilled in the art from the following detailed description, which, taken in conjunction with the annexed drawings, discloses preferred embodiments of the shoe sole.

BRIEF DESCRIPTION OF THE DRAWINGS

Referring now to the attached drawings which form a part of this original disclosure.

DETAILED DESCRIPTION

Selected embodiments will now be explained with reference to the drawings. It will be apparent to those skilled in the shoe field from this disclosure that the following descriptions of the embodiments are provided for illustration only and not for the purpose of limiting the invention as defined by the appended claims and their equivalents.

Figure 1:
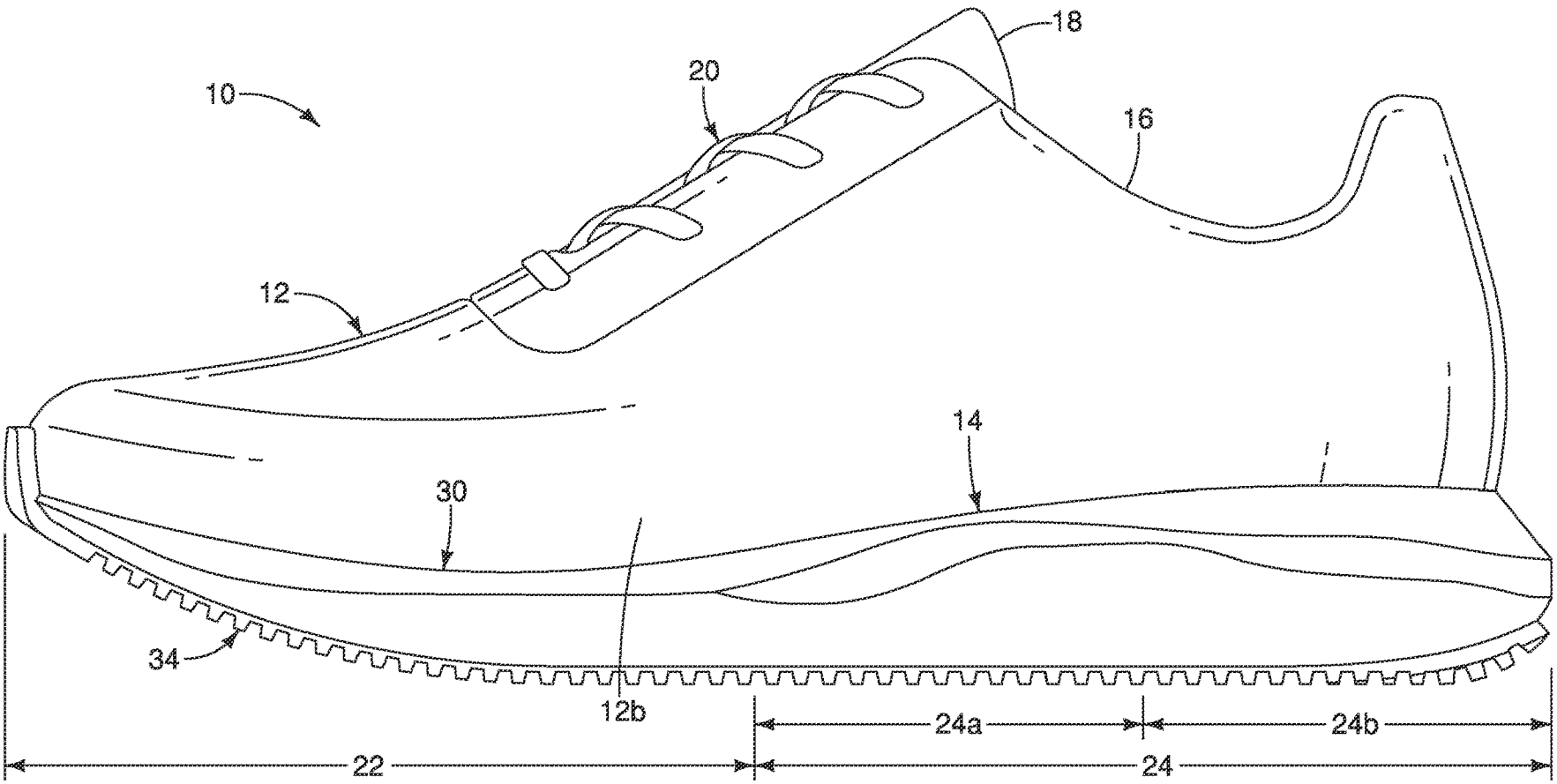
FIG. 1 is a side elevational view of a shoe having a shoe sole in accordance with a first embodiment.
Figure 2:
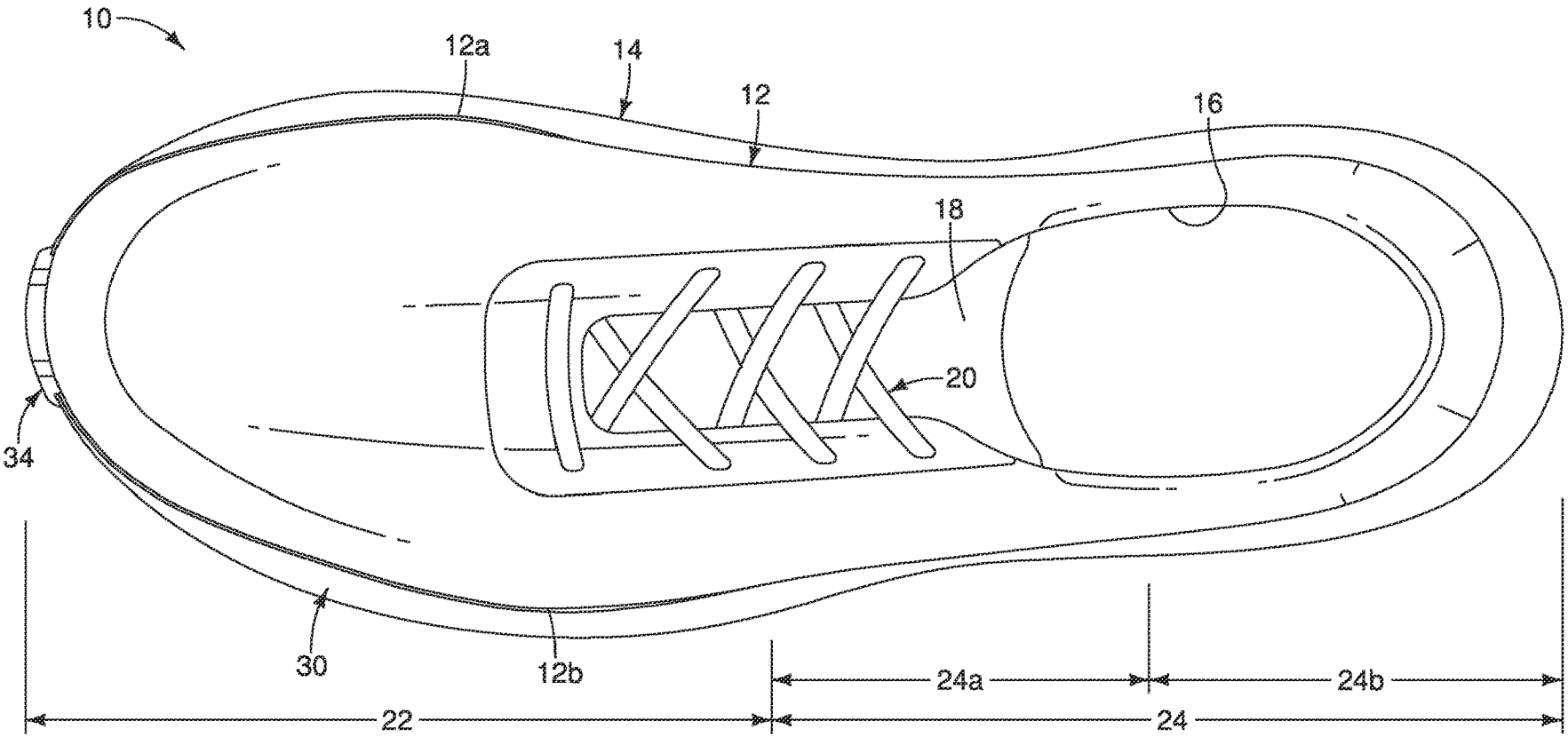
FIG. 2 is a top plan view of the shoe illustrated in FIG. 1.
Figure 3:
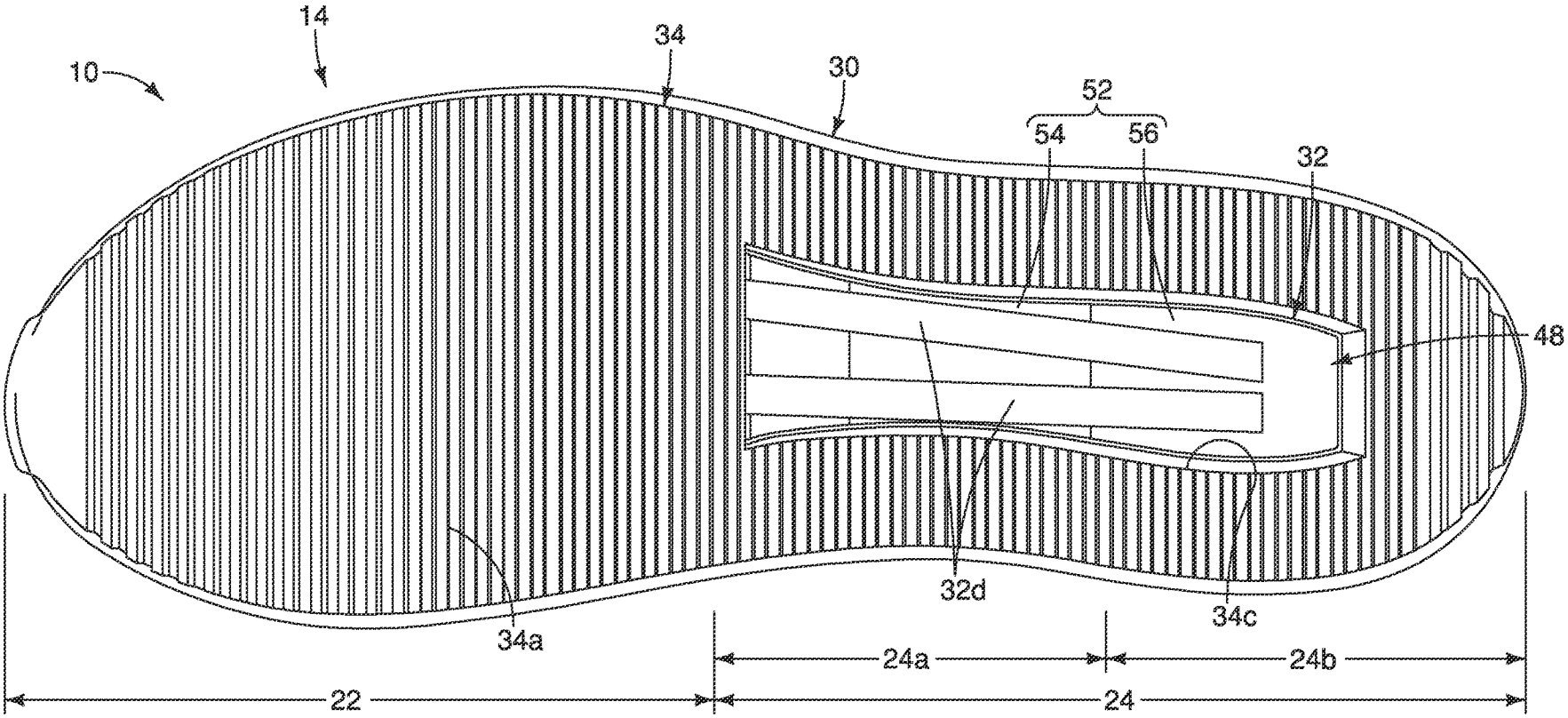
FIG. 3 is a bottom plan view of the shoe illustrated in FIG. 1.
Figure 4:
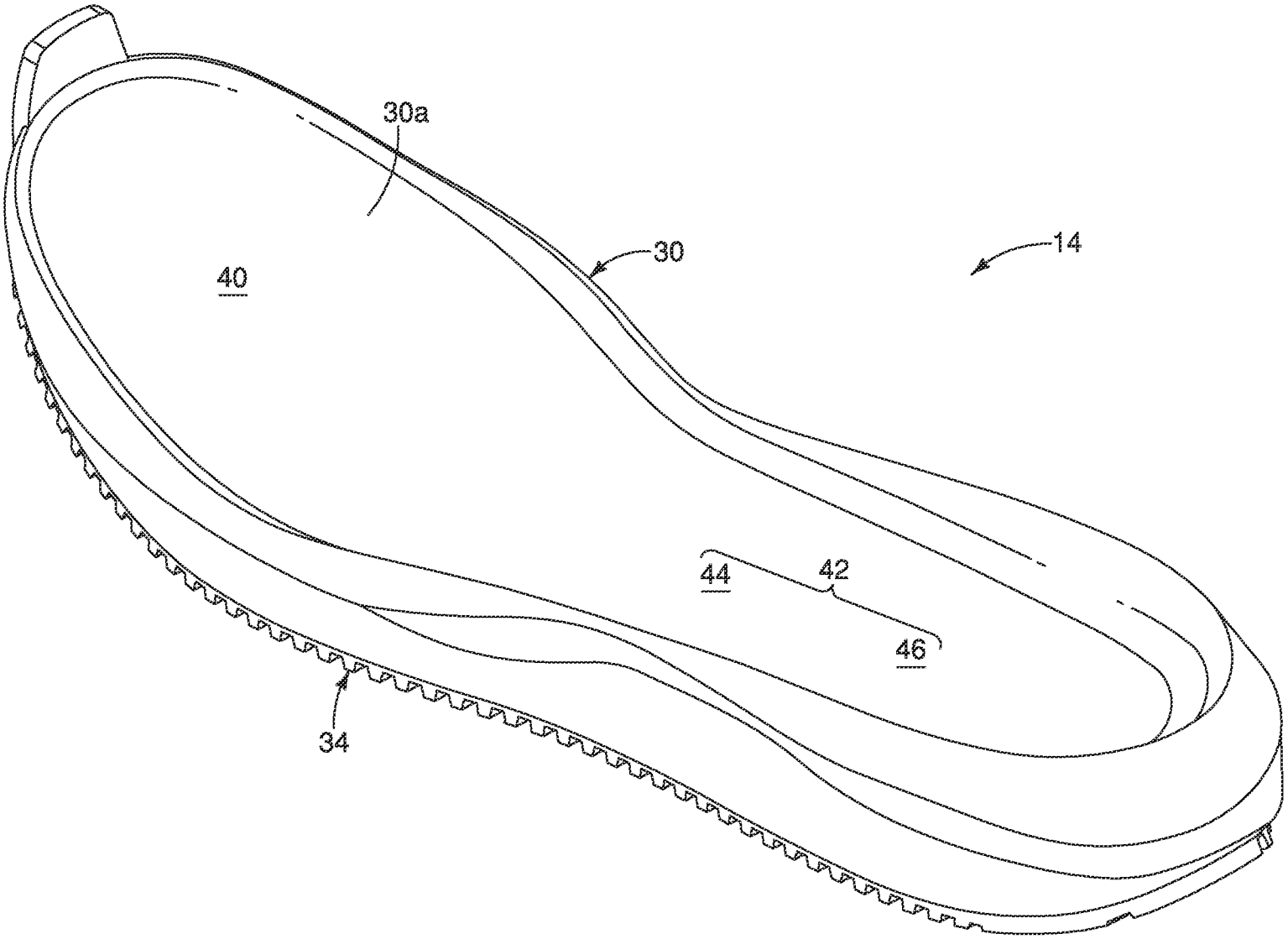
FIG. 4 is a first top perspective view of the shoe sole of the shoe illustrated in FIGS. 1 to 3 as viewed from an outer side of the shoe sole.
Figure 5:
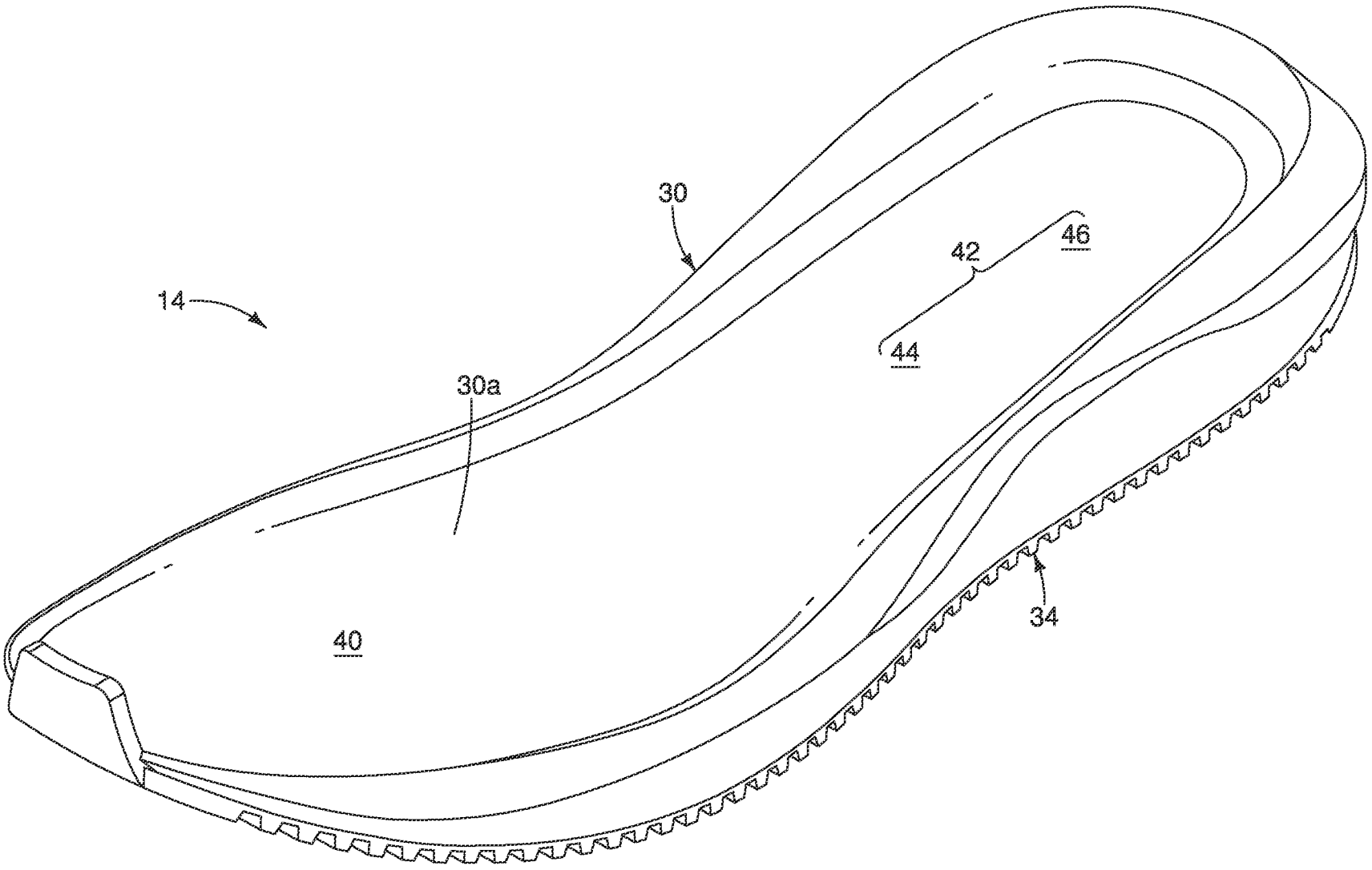
FIG. 5 is a second top perspective view of the shoe sole illustrated in FIGS. 4 to 3 as viewed from an outer side of the shoe sole.

Referring initially to FIGS. 1 to 3, a shoe 10 is illustrated in accordance with a first embodiment of the present disclosure. The shoe 10 is a left shoe of a pair of left-right symmetric ones, in which the right shoe is omitted. The right shoe is identical to the shoe 10 (the left shoe), except that the right shoe is a mirror image of the shoe 10 (the left shoe). Accordingly, description of the shoe 10 applies equally to the right shoe. Therefore, a description will be provided for only one of the shoes (the left shoe 10). The shoe 10 is especially suitable for cycling or other human-powered vehicles having pedals. However, the shoe 10 can be used for other actives other than cycling and pedaling human-powered vehicles.

It should be understood from the drawings and the description herein that the terms "inner side" and "inboard side" refer to the right side of a shoe for the left foot, and the left side of a shoe for the right foot. In other words, the inner side or the inboard side is the side of the shoe facing the shoe on the other foot of the wearer. Similarly, the terms "outer side" and "outboard side" refer to the left side of the shoe for the left foot and the right side of the shoe for the right foot. The outer side or the outboard side is the side of the shoe facing away from the shoe on the other foot. As well, the terms "inner side" and "inboard side" are used interchangeably with respect to the present disclosure. Similarly, the terms "outer side" and "outboard side" are also used interchangeably with respect to the description of the present disclosure. Also, the term "outer instep side" refer to the left side of the shoe in the instep area for the left foot and the right side of the shoe in the instep area for the right foot. Similarly, the term "inner instep side" refer to the right side of the shoe in the instep area for the left foot and the left side of the shoe in the instep area for the right foot.

Basically, the shoe 10 comprises an upper 12 and a shoe sole 14. In other words, the shoe 10 comprises the shoe sole 14 and further comprises the upper 12 which is coupled to the shoe sole 14. The shoe sole 14 supports the upper 12. Specifically shoe sole 14 is attached to the upper 12. For example, the shoe sole 14 can be fixedly attached to the upper 12 in a conventional manner, such as with stitching, adhesives, and/or embedding portions of the upper 12 within the shoe sole 14. Thus, the upper 12 and the shoe sole 14 are integrated together. In the illustrated embodiment, the sole 14 is especially useful for cycling. Thus, alternatively, the shoe 10 can further include a cleat attachment structure for attaching a cleat is needed and/or desired.

Here, the upper 12 is a low-cut style of upper. However, the upper 12 is not limited to the low-cut style, but may be of any style. The upper 12 is made of any suitable natural or polymetric materials. The upper 12 can be formed of an expandable material or a non-expandable material. For example, the upper 12 can be made of a leather material, a nylon mesh and/or any other material that is utilized for conventional uppers. Alternatively, the upper 12 can be made of a stretchable material or stretchable fabric which has the ability to stretch and elastically return to an original unstretched state. For example, the stretchable material can be partially made of elastic fibers, such as Lycra, Spandex or elastane, and/or can be a knit fabric which stretches due to a series of interlocking loops formed in the production of the upper 12.

As seen in FIG. 2, the upper 12 includes a first lateral side 12*a* and a second lateral side 12*b*. The upper 12 includes a foot receiving opening 16 formed between the first lateral side 12*a* and the second lateral side 12*b*. The upper 12 further includes a tongue 18 between the first lateral side 12*a* and the second lateral side 12*b*. Here, the upper 12 further includes a fastening structure 20 (e.g., a shoe lace for securing the shoe 10 to wearer's foot. Alternatively, the fastening structure 20 can include at least one strap tightener and at least one shoe strap or lace extending between the first lateral side 12*a* and the second lateral side 12*b*. Alternatively, the upper 12 can include one or more fixing straps having a hook and loop fastener attachment with fabric hook and loop fastening materials. Since fastening structures for securing a shoe to a wearer's foot are conventional and well-known structures, a detail description of the fastening structures are omitted for the sake of brevity. Since the present disclosure is applicable to a variety of differing shoe styles, designs and configuration, the depicted embodiment shows a basic shoe design that is made of several textile based materials that are sewn or stitched together to form the depicted shape. However, the present disclosure is not limited to the depicted shape, as will be understood from the description of the present disclosure below.

The shoe sole 14 includes a forefoot part 22 and the tarsal part 24. The tarsal part 24 of the shoe sole 14 can be further subdivided into a midfoot part 24*a* and a hindfoot part 24*b*. Basically, the bones of a person's foot can be divided into three groups (i.e., the phalanges, the metatarsals and the tarsals. In describing the shoe sole 14, the term "forefoot part" as used herein refers the portion or part of the shoe sole that supports the phalanges and the metatarsals of the person's foot, while the term "tarsal part" as used herein refers the portion or part of the shoe sole that supports the tarsals of the person's foot. The tarsals of the foot are organized into three groups: proximal, intermediate, and distal. The proximal group includes the tarsal bones that include the talus and the calcaneus. The intermediate group contains one bone, the navicular. The distal group includes the cuboid and the three cuneiforms. The term "midfoot part" as used herein refers the portion or part of the shoe sole that supports the navicular, cuboid, and cuneiforms of the person's foot, while the term "hindfoot part" as used herein refers the portion or part of the shoe sole that supports the talus and calcaneus of the person's foot. The "hindfoot part" can also be referred to as the heel part.

As seen in FIGS. 7 to 10, the shoe sole 14 is made of at least two layers. In particular, the shoe sole 14 basically comprises a first layer 30 and a second layer 32. In the illustrated embodiments, the shoe sole 14 further comprises a third layer 34. Here, each of the first layer 30, the second layer 32 and the third layer 34 is a one-piece member. The first layer 30, the second layer 32 and the third layer 34 are integrated together as a unit. Basically, the second layer 32 is more rigid than the first layer 30. Preferably, the second layer 32 is rigid member that does not deform under normal use. On the other hand, the first layer 30 is preferably formed of a deformable material that can bend. The third layer 34 is also preferably formed of a deformable material that can bend. Preferably, the material of the third layer 34 is a different material than the material of the first layer 30.

In the illustrated embodiments, the first layer 30 includes a foam material.

Figure 10:
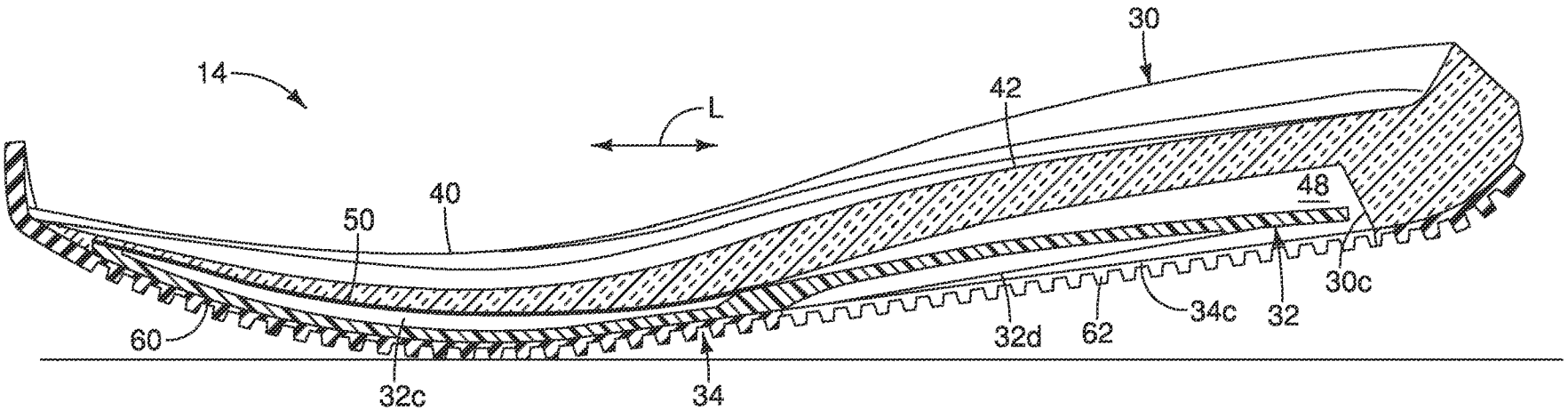
FIG. 10 is a longitudinal cross sectional view, similar to FIG. 9, of the shoe sole illustrated in FIGS. 4 to 6 but in which the shoe sole has been flexed.
Figure 11:
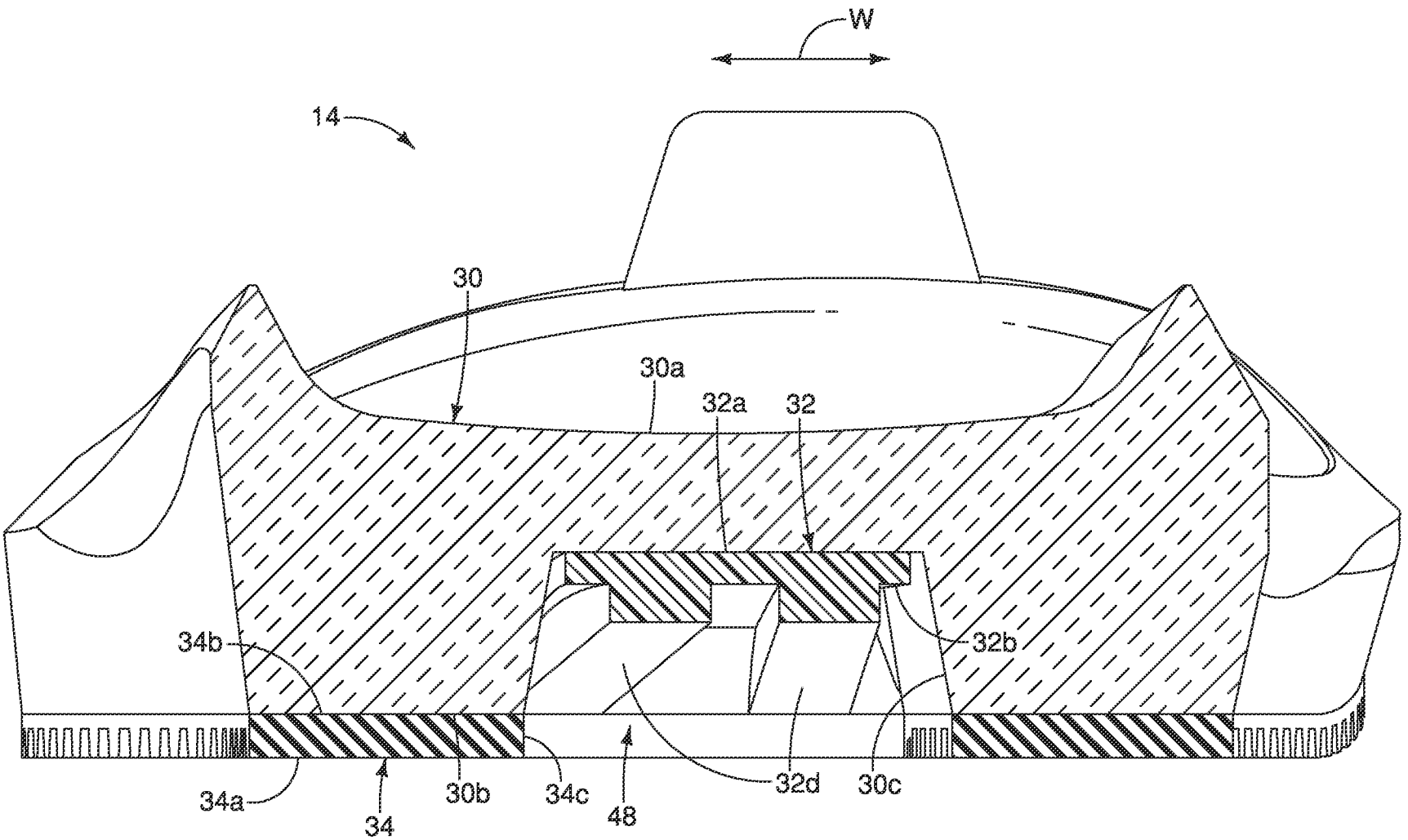
FIG. 11 is a widthwise cross sectional view of the shoe sole illustrated in FIGS. 4 to 6 taken along section line 11-11 of FIG. 6 in a non-flex state (i.e., non-deformed state).
Figure 12:
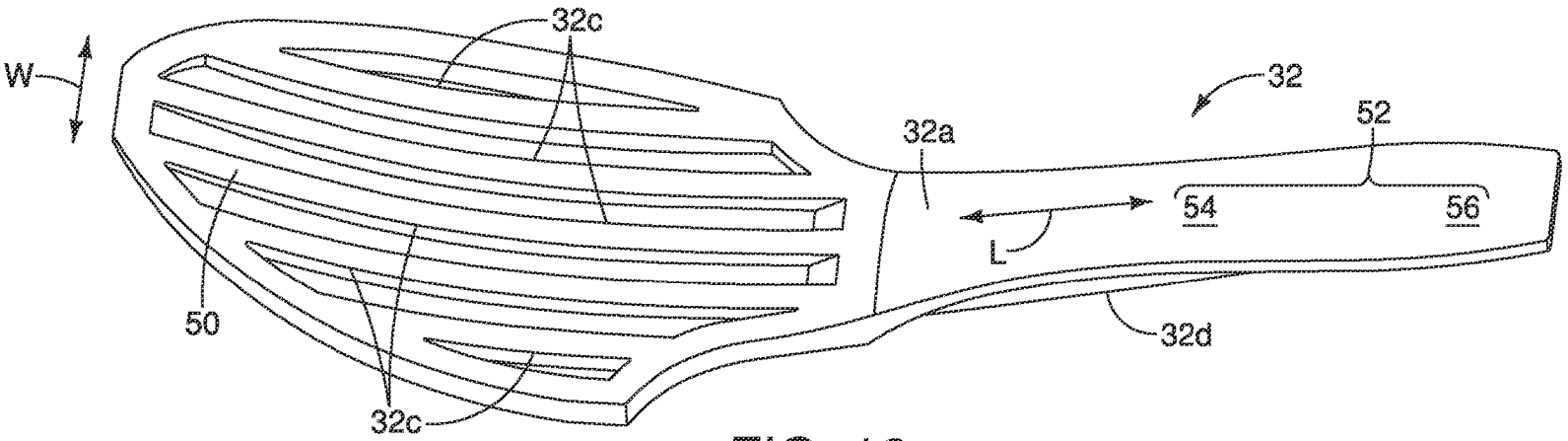
FIG. 12 is a perspective view of the second layer of the shoe sole illustrated in FIGS. 4 to 6.
Figure 13:
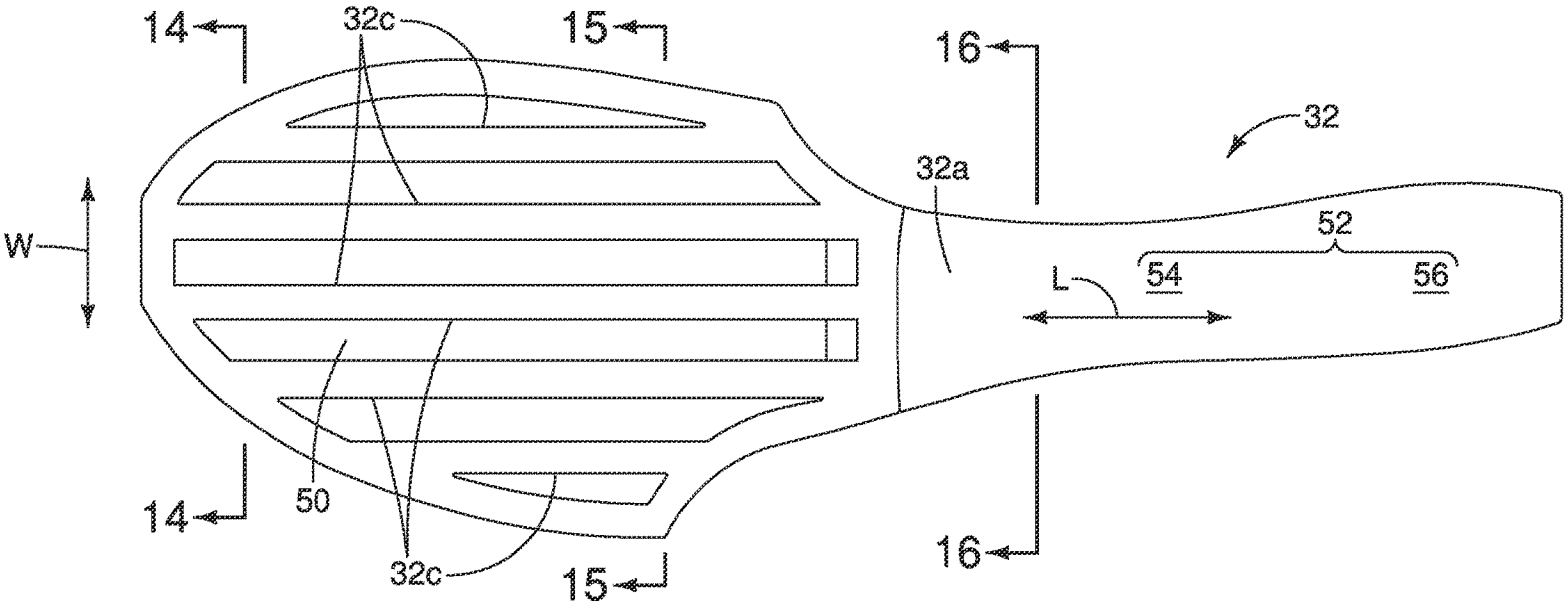
FIG. 13 is a top plan view of the second layer of the shoe sole illustrated in FIG. 12.
Figure 14:
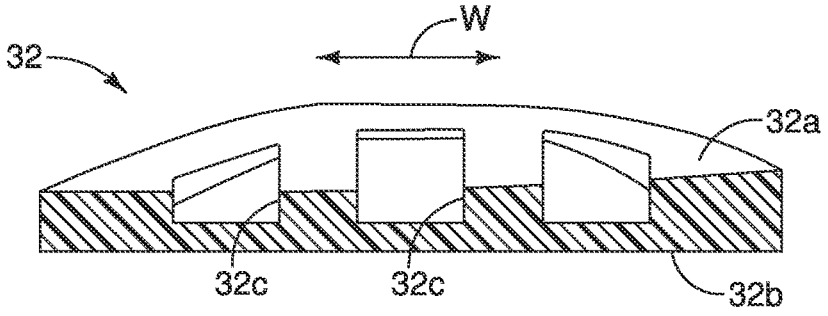
FIG. 14 is a widthwise cross sectional view of the second layer of the shoe sole illustrated in FIGS. 12 and 13 taken along section line 14-14 of FIG. 13.
Figure 15:
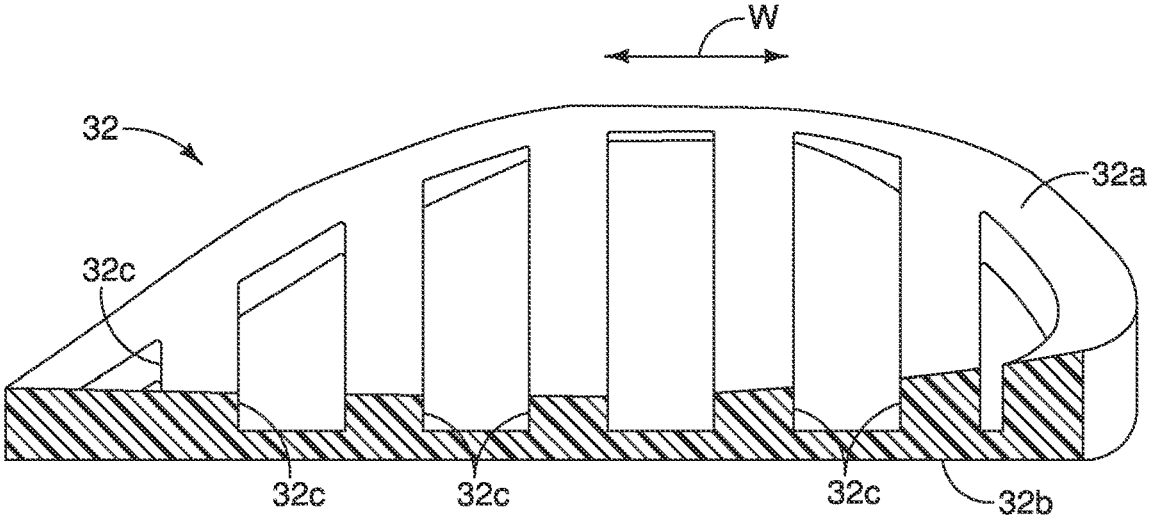
FIG. 15 is a widthwise cross sectional view of the second layer of the shoe sole illustrated in FIGS. 12 and 13 taken along section line 15-15 of FIG. 13.
Figure 16:
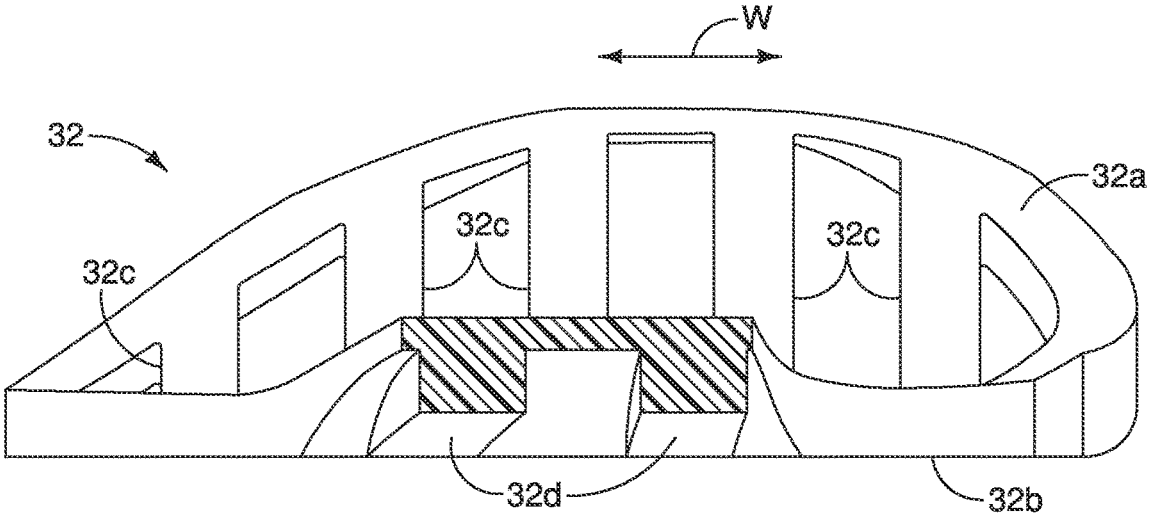
FIG. 16 is a widthwise cross sectional view of the second layer of the shoe sole illustrated in FIGS. 12 and 13 taken along section line 16-16 of FIG. 13.

Preferably, the foam material includes an ethylene-vinyl acetate foam. Alternatively, the foam material includes a polyurethane foam. By forming the first layer 30 of a foam material, the first layer 30 can bend while walking as seen in FIG. 10. The first layer 30 can be formed by molding. The first layer 30 is a cushioning layer of the shoe sole 14. Preferably, the first layer 30 is compressible. For example, the first layer 30 can be compressed between the wearer's foot and the ground when the shoe sole 14 contacts the ground with an impact that occurs during running. The first layer 30 has a first surface 30*a* and a second surface 30*b* that facings in the opposite direction to the first surface 30*a*. Here, the first surface 30*a* is a top surface and the second surface 30*b* is a bottom surface. The second surface 30*b* is provided with a recess 30*c* for receiving the second layer 32.

The first layer 30 includes a forefoot part 40 and a tarsal part 42. The forefoot part 40 of the first layer 30 corresponds to the forefoot part 22 of the shoe sole 14. The tarsal part 42 of the first layer 30 corresponds to the tarsal part 24 of the shoe sole 14. The tarsal part 42 of the first layer 30 includes a midfoot part 44 and a hindfoot part 46. The midfoot part 44 of the first layer 30 corresponds to the midfoot part 24*a* of the shoe sole 14. The hindfoot part 46 of the first layer 30 corresponds to the hindfoot part 24*b* of the shoe sole 14. The first layer 30 includes a space 48. The space 48 is formed by the recess 30*c* in the tarsal part 42 of the first layer 30. The space 48 is sized so that the location of the second layer 32 within the recess 30*c* changes when the first layer 30 flexes during walking or running. Thus, the depth of the space 48 is larger than the thickness of the second layer 32 so that the tarsal part 42 of the first layer 30 can be displaced relative to the second layer 32 during flexing of the shoe sole 14 such as during walking, jogging, running, etc.

In the illustrated embodiments, the second layer 32 includes a resin material. Preferably, the resin material includes a polyamide material. Also, preferably, the resin material includes a fiber material. For example, the fiber material includes a plurality of carbon fibers. Alternatively, for example, the fiber material includes a plurality of glass fibers. In other words, the material of the second layer 32 can be a fiber (e.g., carbon fibers, glass fibers, etc.) reinforced plastic (FRP). By forming the second layer 32 of a rigid resin material, the second layer 32 will not deform (e.g., bend) during flexing of the shoe sole 14 such as during walking, jogging, running, etc. as seen in FIG. 10. The second layer 32 can be formed by molding. The second layer 32 has a first surface 32*a* and a second surface 32*b* that facings in the opposite direction to the first surface 32*a*. Here, the first surface 32*a* is a top surface and the second surface 32*b* is a bottom surface.

The second layer 32 has a forefoot part 50 and a tarsal part 52. As explained below, the forefoot part 50 extends along the first layer 30 and the tarsal part 52 is configured to be displaceable relative to the first layer 30. The forefoot part 50 of the second layer 32 corresponds to the forefoot part 22 of the shoe sole 14. The tarsal part 52 of the second layer 32 corresponds to the tarsal part 24 of the shoe sole 14. The tarsal part 52 of the second layer 32 includes a midfoot part 54 and a hindfoot part 56. The midfoot part 54 of the second layer 32 corresponds to the midfoot part 24*a* of the shoe sole 14. The hindfoot part 56 of the second layer 32 corresponds to the hindfoot part 24*b* of the shoe sole 14.

The second layer 32 has a longitudinal direction L extending between the forefoot part 50 and the tarsal part 52. The second layer 32 has a width direction W perpendicular to the longitudinal direction L. The forefoot part 50 is wider than the tarsal part 52 in the width direction W. The second layer 32 is shorter than the first layer 30 in the longitudinal direction L. The tarsal part 52 of the second layer 32 is configured to be received in the space 48 defined by the recess 30*c*. The tarsal part 52 is configured to be displaceable relative to the first layer 30 into the space 48 in the first layer 30 in a state where the first layer 30 is flexed.

Preferably, the second layer 32 includes at least one first protrusion disposed on one of the forefoot part 50 and the tarsal part 52. Also, preferably, the second layer 32 includes at least one second protrusion disposed on the other one of the forefoot part 50 and the tarsal part 52. Here, the second layer 32 includes a plurality of the first protrusions 32*c* disposed on the forefoot part 50, and a plurality of the second protrusions 32*d* disposed on the tarsal part 52. Here, the first protrusions 32*c* and the second protrusions 32*d* extend in the longitudinal direction L. Thus, the first protrusions 32*c* can be referred to as first longitudinal ribs and the second protrusions 32*d* can be referred to as second longitudinal ribs.

The third layer 34 preferably includes a rubber material. The rubber material of the third layer 34 can be a natural rubber, a synthetic rubber or a blend of natural and synthetic rubbers. Here, the third layer 34 includes an elastic polymer material such as synthetic rubber or polyurethane (e.g., a thermoplastic polyurethane). The third layer 34 can be formed by injection molding. The third layer 34 has a ground contact surface 34*a*. The ground contact surface 34*a* preferably includes a tread to provide traction for the shoe sole 14 during use. The third layer 34 has an attachment surface 134*b* that is attached to the first layer 30 and the second layer 32 as described below.

The third layer 34 includes a forefoot part 60 and a tarsal part 62. The forefoot part 60 of the third layer 34 corresponds to the forefoot part 22 of the shoe sole 14. The tarsal part 62 of the third layer 34 corresponds to the tarsal part 24 of the shoe sole 14. The tarsal part 62 of the third layer 34 includes a midfoot part 64 and a hindfoot part 66. The midfoot part 64 of the third layer 34 corresponds to the midfoot part 24*a* of the shoe sole 14. The hindfoot part 66 of the third layer 34 corresponds to the hindfoot part 24*b* of the shoe sole 14.

In the illustrated embodiments, the first layer 30, the second layer 32 and the third layer 34 are joined together as an integrated unit that is attached to the upper 12. Basically, the second layer 32 is disposed between the first layer 30 and the third layer 34. In particular, the first layer 30 overlies the second layer 32. In the first illustrated embodiment, the first layer 30 completely overlies the first surface 32*a* of the second layer 32. The second layer 32 overlies the third layer 34. Preferably, the second layer 32 is coupled to the first layer 30. In particular, the forefoot part 50 is bonded to the first layer 30. More specifically, the forefoot part 50 of the second layer 32 is coupled to the forefoot part 40 of the first layer 30. However, the tarsal part 52 of the second layer 32 is not coupled to the tarsal part 42 of the first layer 30. In the first embodiment, the tarsal part 52 of the second layer 32 contacts the tarsal part 42 of the first layer 30, but the tarsal part 42 of the first layer 30 can be displaced relative to the tarsal part 52 of the second layer 32 when the shoe sole 14 is flexed. Preferably, the third layer 34 is coupled to the first layer 30. Also, preferably, the third layer 34 is coupled to the second layer 32. In the illustrated embodiments, the third layer 34 is bonded to the second layer 32. In particular, the third layer 34 is coupled to the forefoot part 50 of the second layer 32. The attachment of the first layer 30, the second layer 32 and the third layer 34 can be accomplished by bonding using an adhesive or by bonding through an over-molding process. Of course, other bonding techniques can be used as needed and/or desired. For example, the forefoot part 40 of the first layer 30 can be molded or adhesively attached to the first surface 32*a* of the forefoot part 50 of the second layer 32. The third layer 34 can be adhesively attached to the second surface 30*b* of the first layer 30, and adhesively attached to the second surface 32*b* of the second layer 32.

Figure 6:
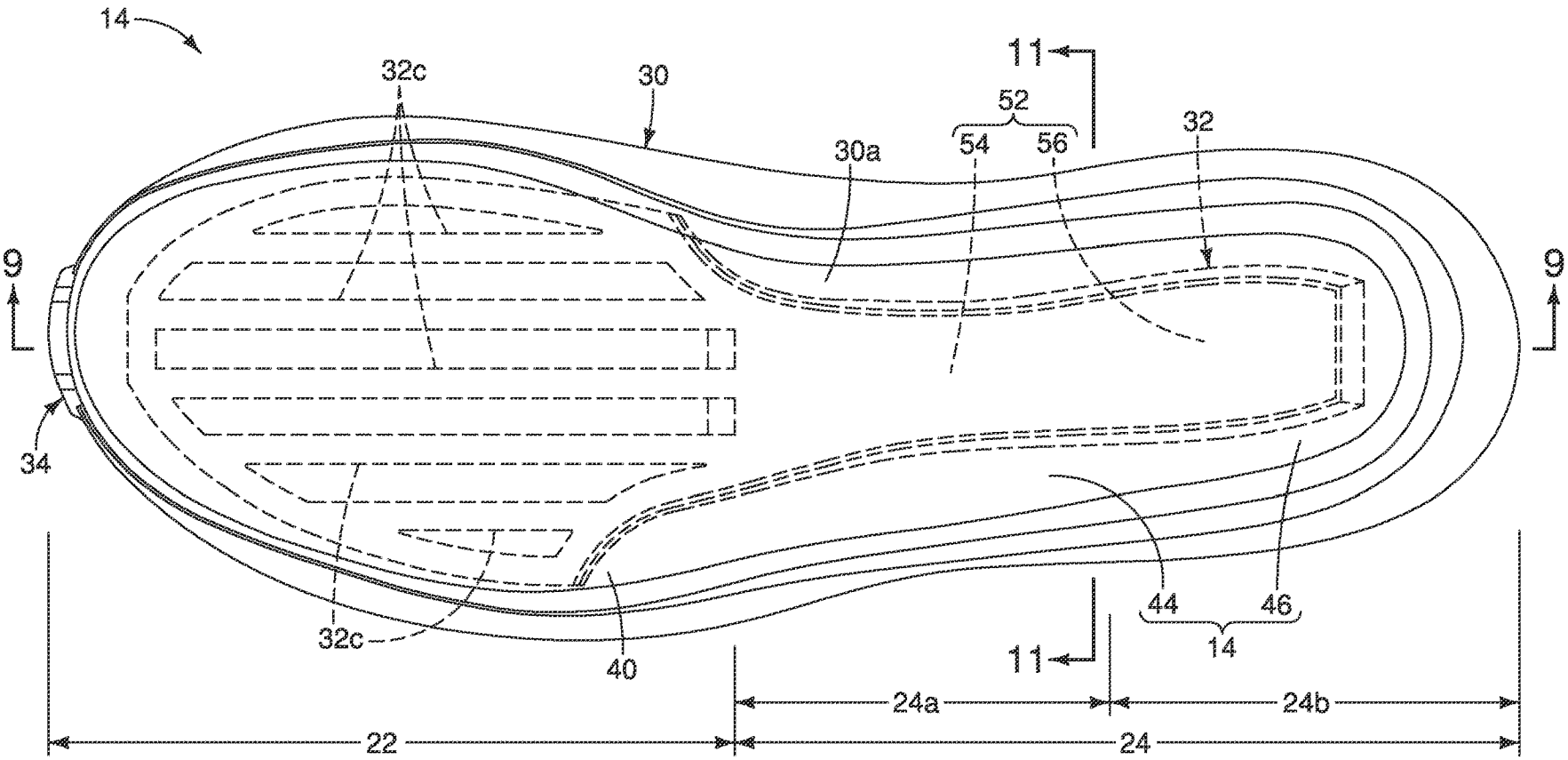
FIG. 6 is a top plan view of the shoe sole illustrated in FIGS. 4 and 5.
Figure 7:
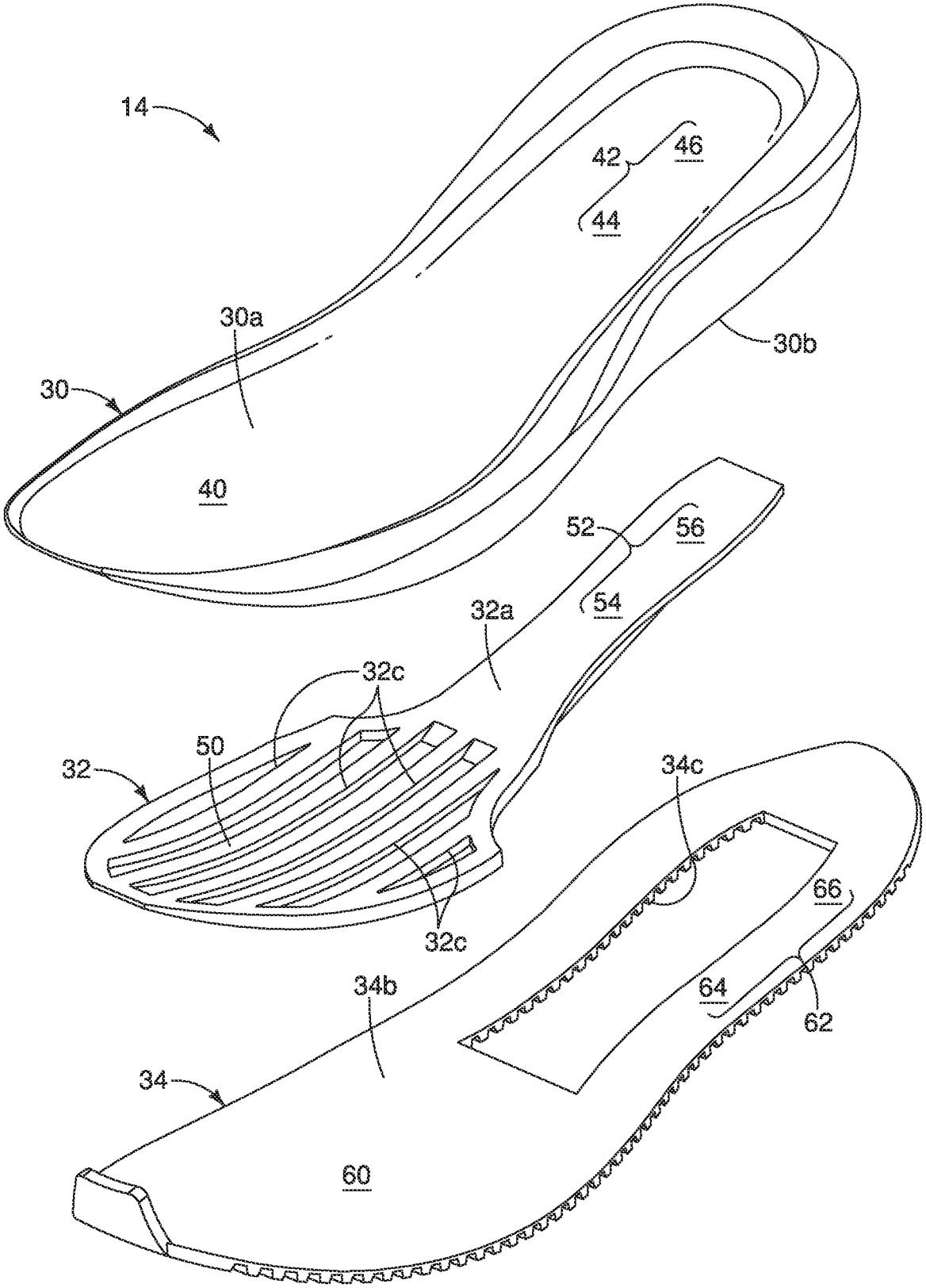
FIG. 7 is an exploded top perspective view of the shoe sole illustrated in FIGS. 4 to 6.
Figure 8:
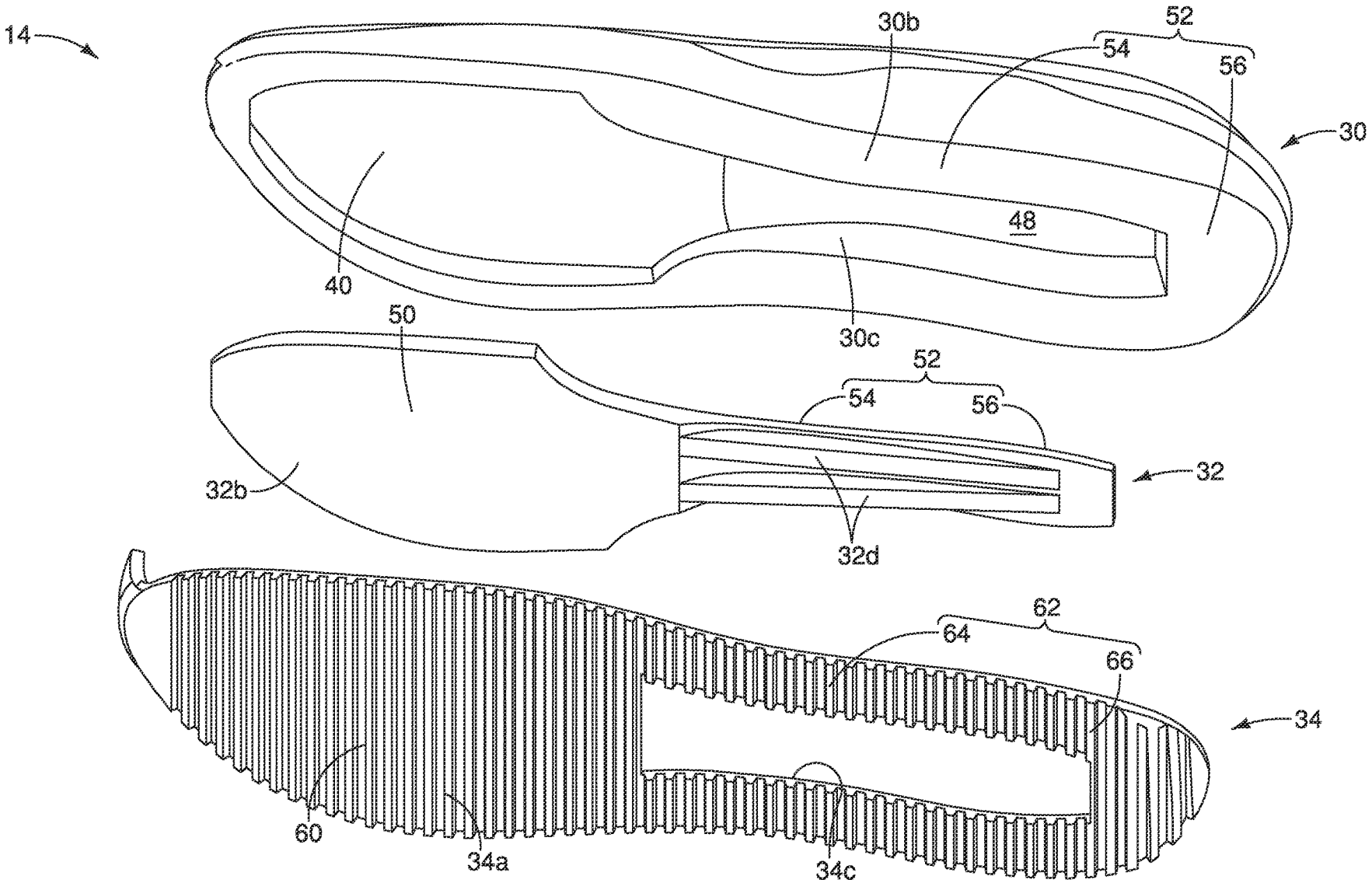
FIG. 8 is an exploded bottom perspective view of the shoe sole illustrated in FIGS. 4 to 6.
Figure 9:
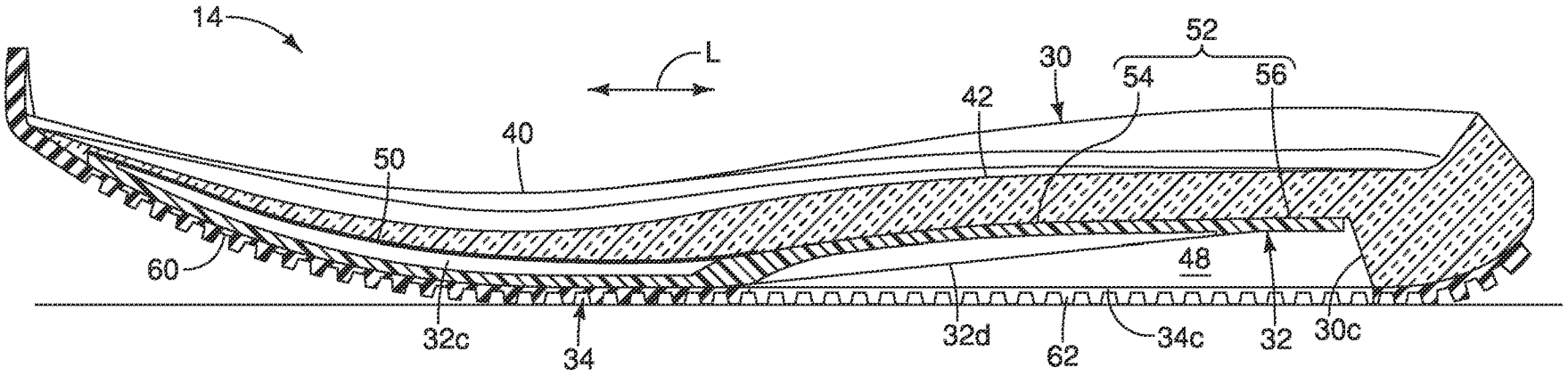
FIG. 9 is a longitudinal cross sectional view of the shoe sole illustrated in FIGS. 4 to 6 taken along section line 9-9 of FIG. 6 in a non-flex state (i.e., non-deformed state).

As seen in FIG. 6, the first layer 30 and the third layer 34 each have an outer shape formed in a foot shape. The outer shape of the first layer 30 is slightly smaller than the outer shape of the third layer 34 as viewed in a plan view as seen in FIG. 6. The second layer 32 is disposed between the first layer 30 and the third layer 34. The periphery of the second layer 32 is completely surrounded by the first layer 30.

Figure 17:
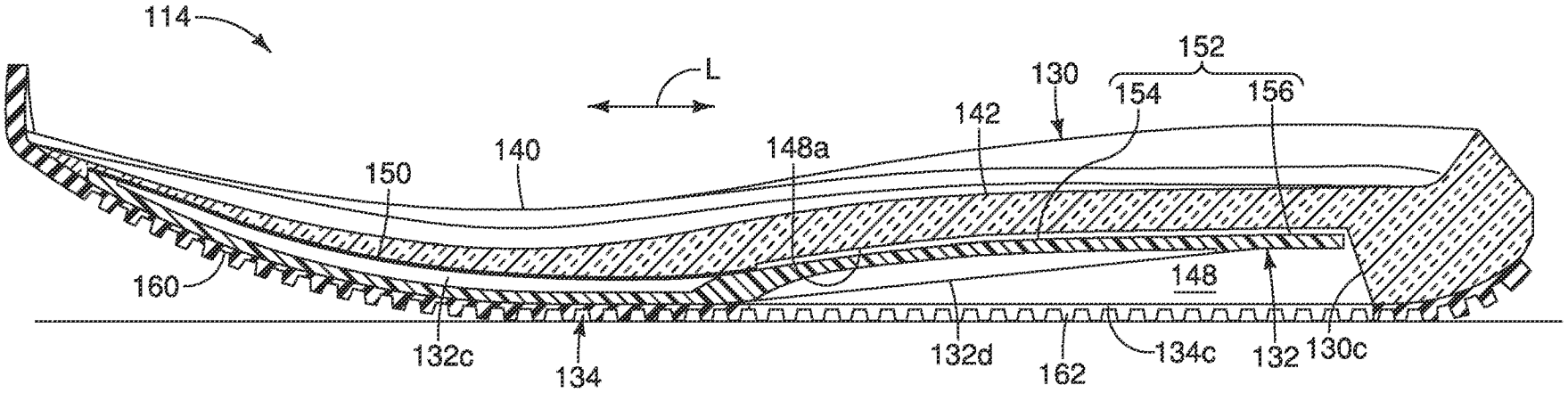
FIG. 17 is a cross sectional view, similar to FIG. 9, of a shoe sole in accordance with a second embodiment in which the shoe sole is in a non-flex state (i.e., non-deformed state).
Figure 18:
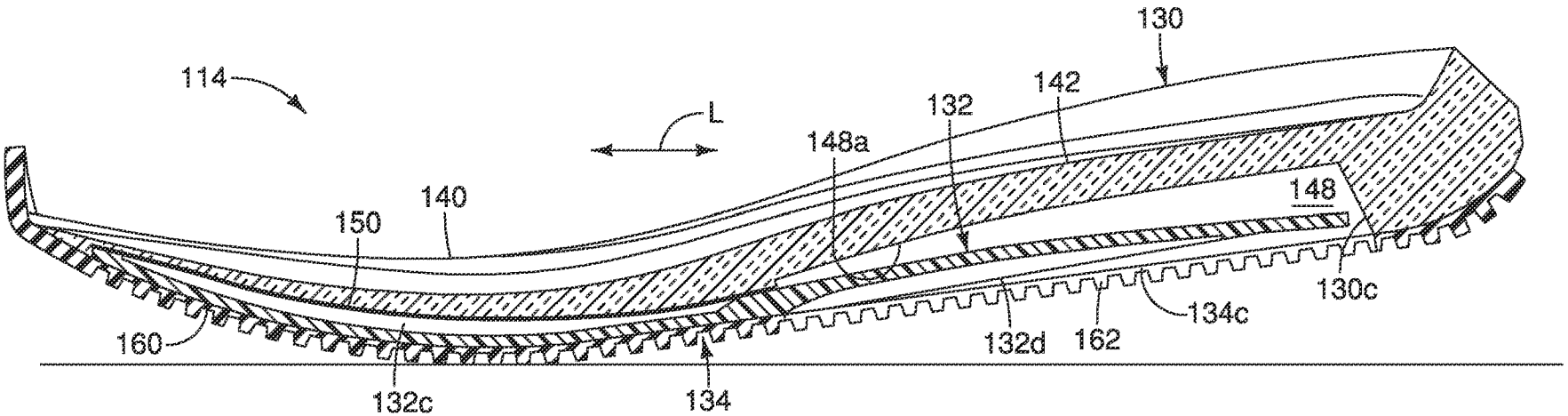
FIG. 18 is a longitudinal cross sectional view of the shoe sole illustrated in FIG. 17 but in which the shoe sole has been flexed.
Figure 19:
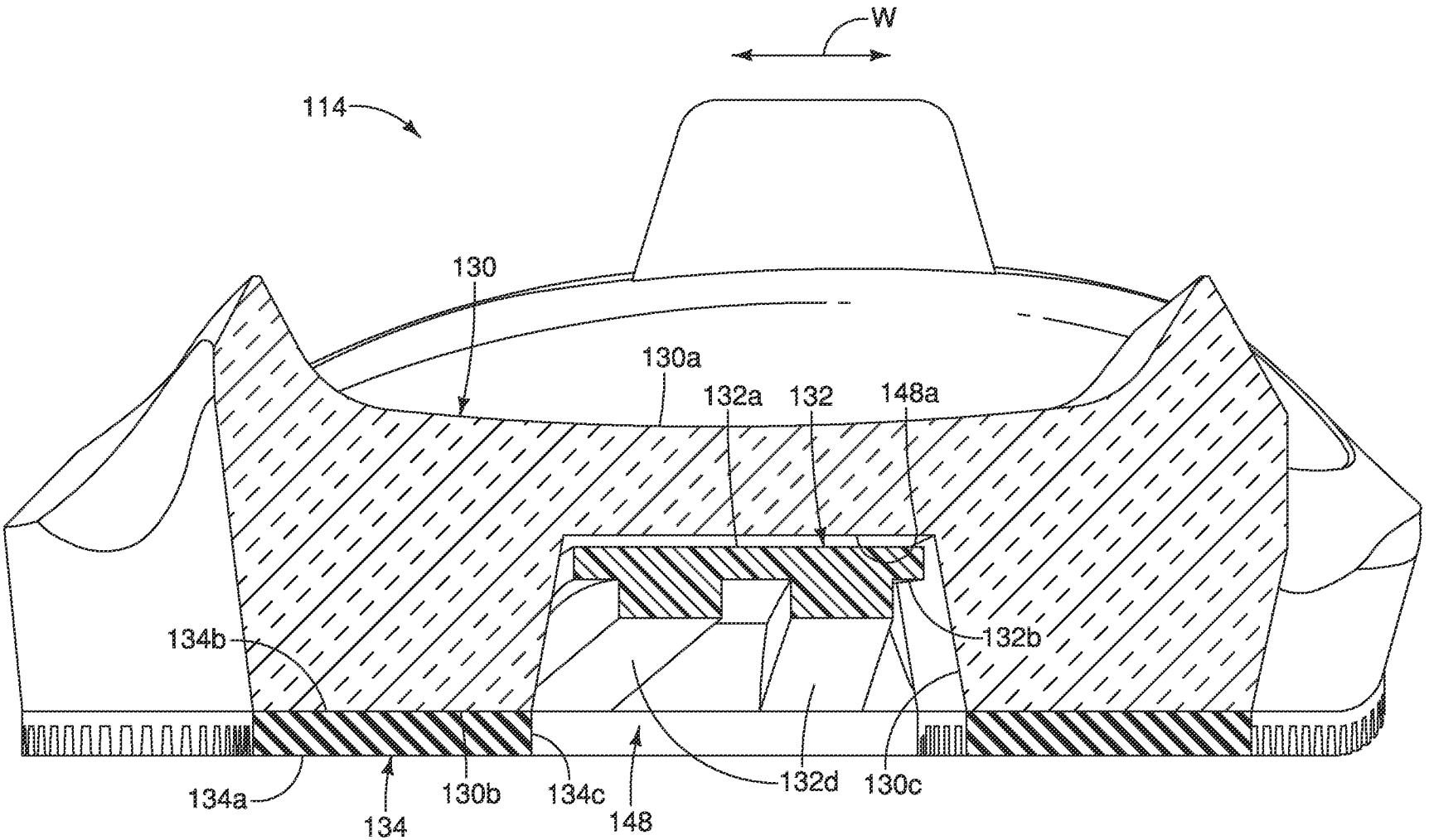
FIG. 19 is a widthwise cross sectional view, similar to FIG. 11, of the shoe sole illustrated in FIGS. 17 and 18.

Referring now to FIGS. 17 to 19, a shoe sole 114 is illustrated in accordance with a second embodiment. The shoe sole 114 is configured to be attached to the upper 12, which is discussed above, to form a shoe. The shoe sole 114 basically comprises a first layer 130, a second layer 132 and a third layer 134. In view of the similarity between the first embodiment and the second embodiment, the descriptions of the parts of the second embodiment that are identical to the parts of the first embodiment may be omitted for the sake of brevity.

The first layer 130 includes a forefoot part 140 and a tarsal part 142. The first layer 130 has a first surface 130*a* and a second surface 130*b* that is provided with a recess 130*c* for defining a space 148. The first layer 130 of the shoe sole 114 is made of the same material as the first layer 30 of the shoe sole 14. The first layer 130 of the shoe sole 114 is identical to the first layer 30 of the shoe sole 14, except that the recess 130*c* has been modified to provide a gap 148*a* between the first layer 130 and the second layer 132. Thus, the description of the first layer 30 applies to the first layer 130 to the extent that they are identical. Here, the gap 148*a* is preferably about two millimeters or less between the first layer 130 and the second layer 132 where the shoe sole 114 is in a non-deformed state. In the second embodiment, the gap 148*a* extends the entire length or substantially the entire length of the tarsal part 142 with respect to the longitudinal direction L.

The second layer 132 has a first surface 132*a* and a second surface 132*b*. The second layer 132 has a forefoot part 150 and a tarsal part 152 having a midfoot part 154 and a hindfoot part 156. The second layer 132 includes a plurality of first protrusions 132*c* and a plurality of second protrusions 132*d*. The second layer 132 of the shoe sole 114 is made of the same material as the second layer 32 of the shoe sole 14. The second layer 132 of the shoe sole 114 is identical to the second layer 32 of the shoe sole 14. Thus, the description of the second layer 32 applies to the second layer 132. However, due to the addition of the gap 148*a*, the tarsal part 152 of the second layer 132 does not contact the first layer 130 where the shoe sole 114 is in a non-deformed state.

The third layer 134 includes a forefoot part 160 and a tarsal part 162. The third layer 134 has a ground contact surface 134*a* and an attachment surface 134*b*. The third layer 134 of the shoe sole 114 is made of the same material as the third layer 34 of the shoe sole 14. The third layer 134 of the shoe sole 114 is identical to the third layer 34 of the shoe sole 14. Thus, the description of the third layer 34 applies to the third layer 134.

Figure 20:
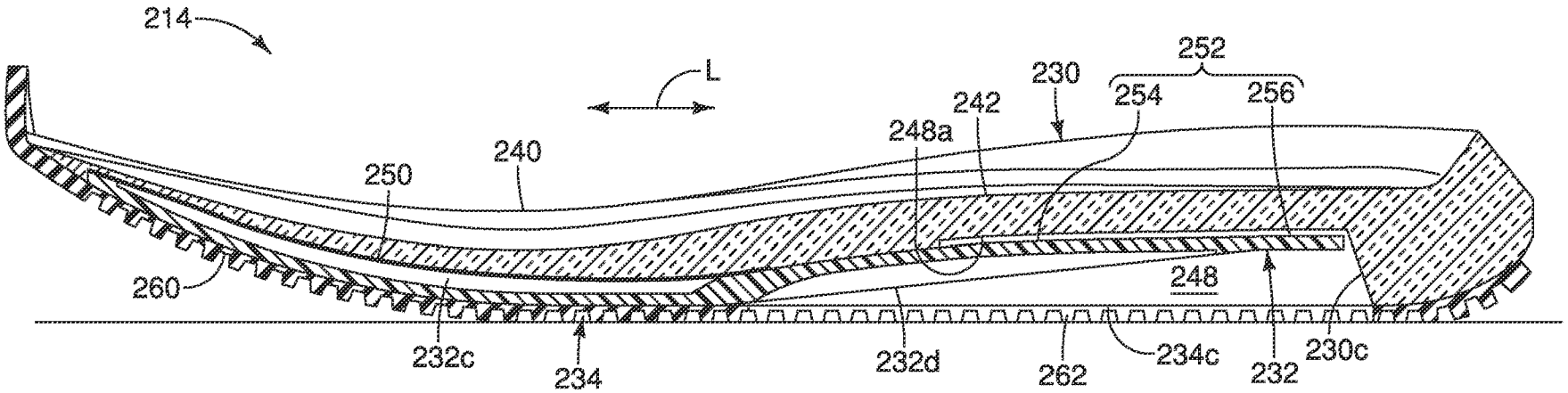
FIG. 20 is a longitudinal cross sectional view, similar to FIGS. 9 and 17, of a shoe sole in accordance with a third embodiment in which the shoe sole is in a non-flex state (i.e., non-deformed state).
Figure 21:
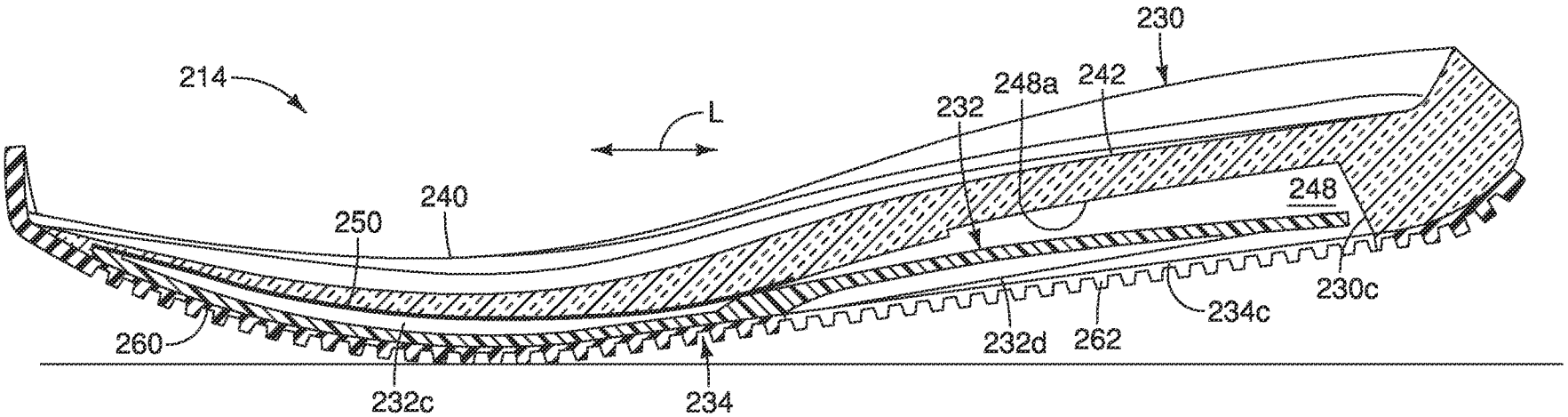
FIG. 21 is a longitudinal cross sectional view of the shoe sole illustrated in FIG. 20 but in which the shoe sole has been flexed.
Figure 22:
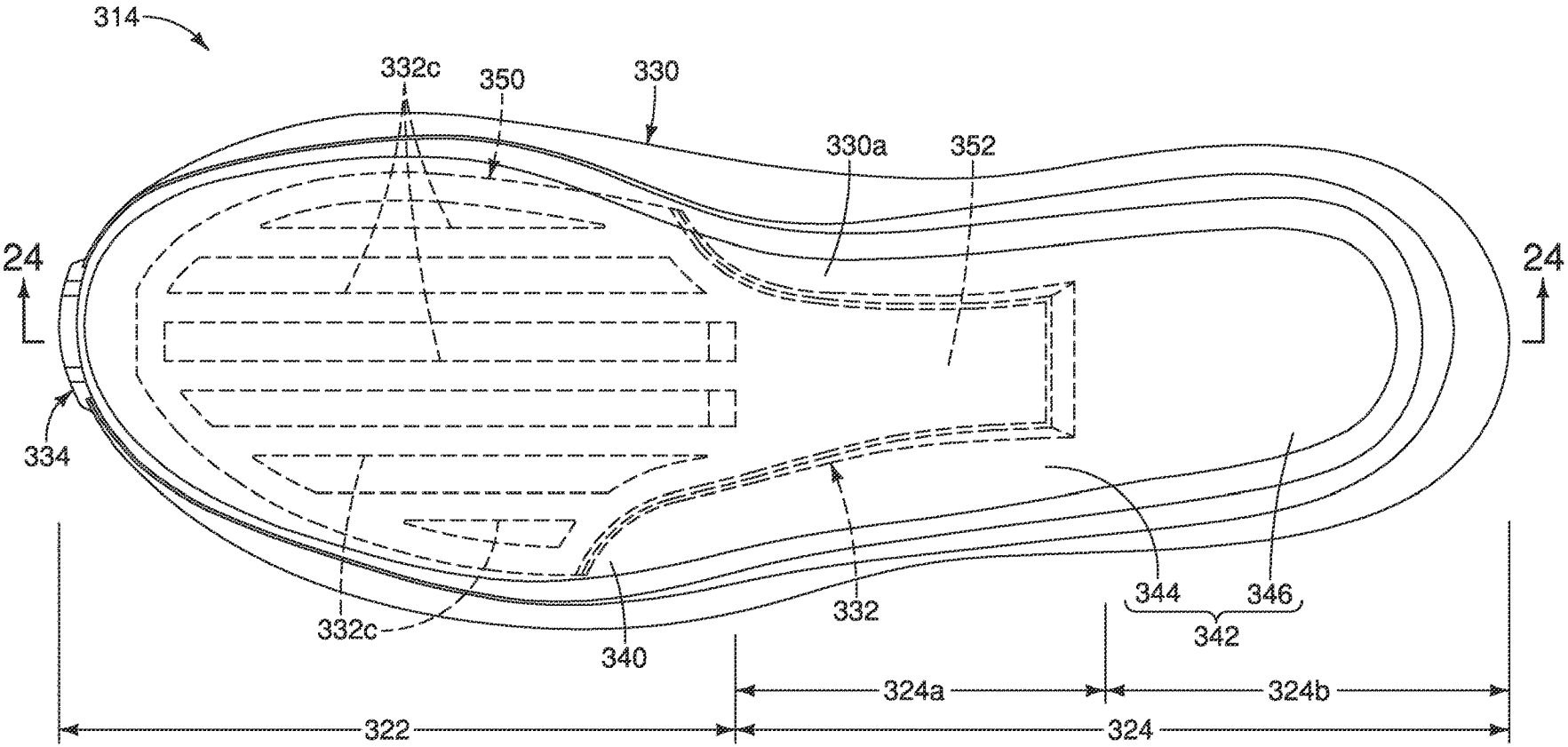
FIG. 22 is a top plan view of a shoe sole in accordance with a fourth embodiment.
Figure 23:
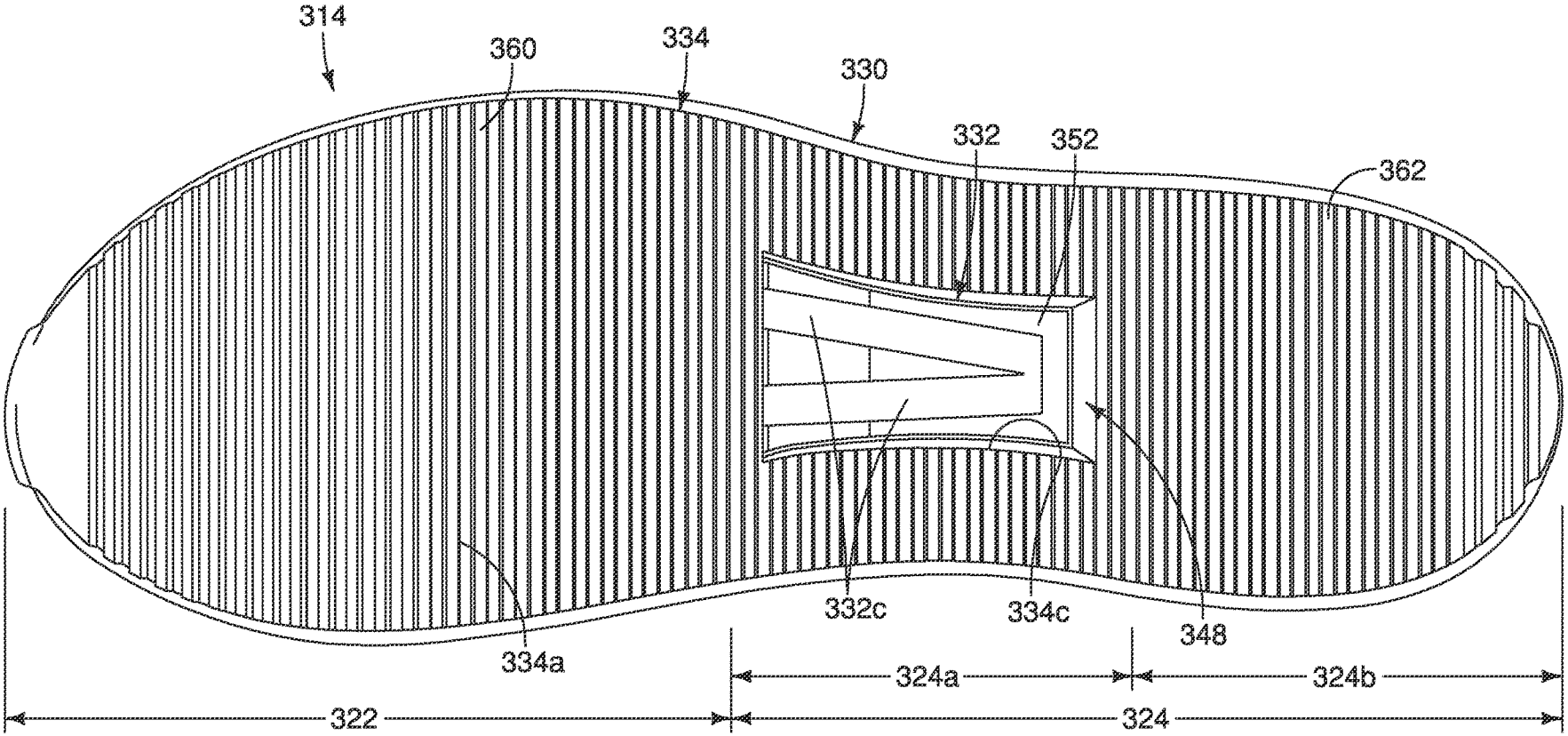
FIG. 23 is a bottom plan view of the shoe sole illustrated in FIG. 22.
Figure 24:
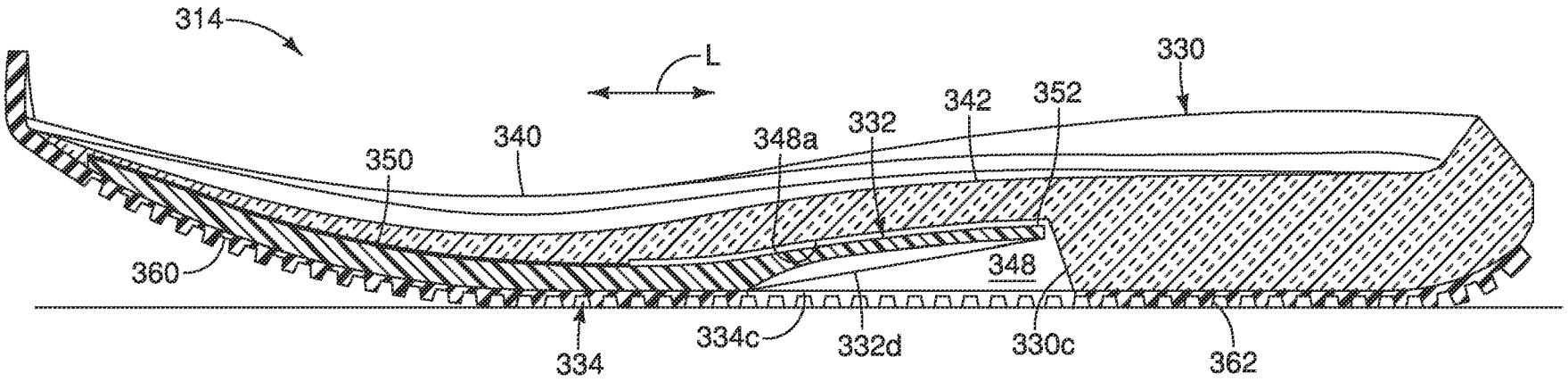
FIG. 24 is a longitudinal cross sectional view, similar to FIGS. 9, 17 and 20, of the shoe sole illustrated in FIGS. 22 and 23.
Figure 25:
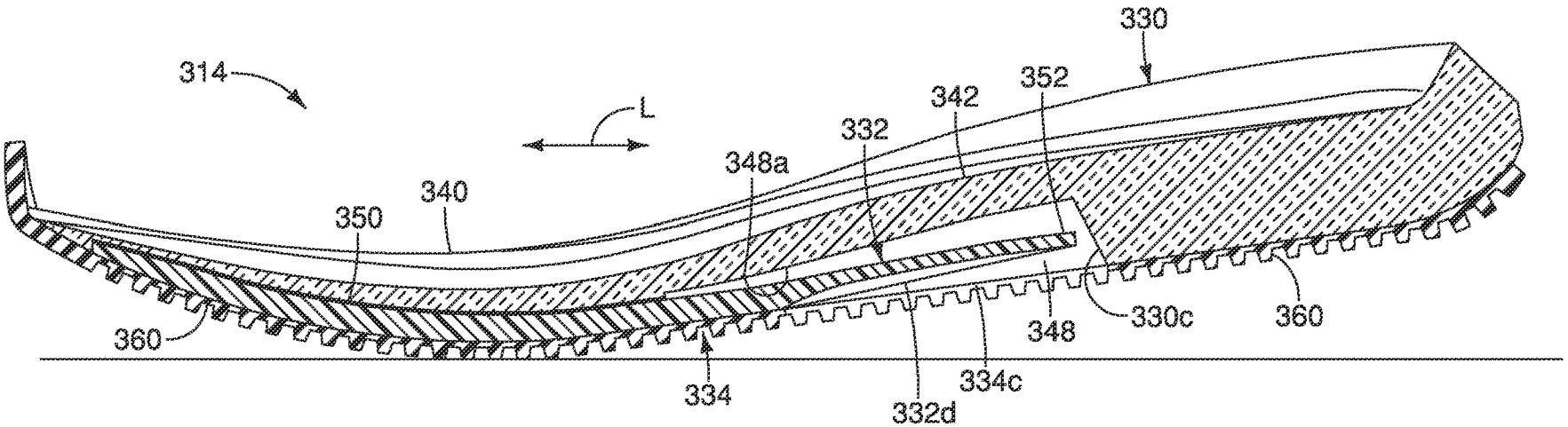
FIG. 25 is a longitudinal cross sectional view of the shoe sole illustrated in FIG. 24 but in which the shoe sole has been flexed.
Figure 26:
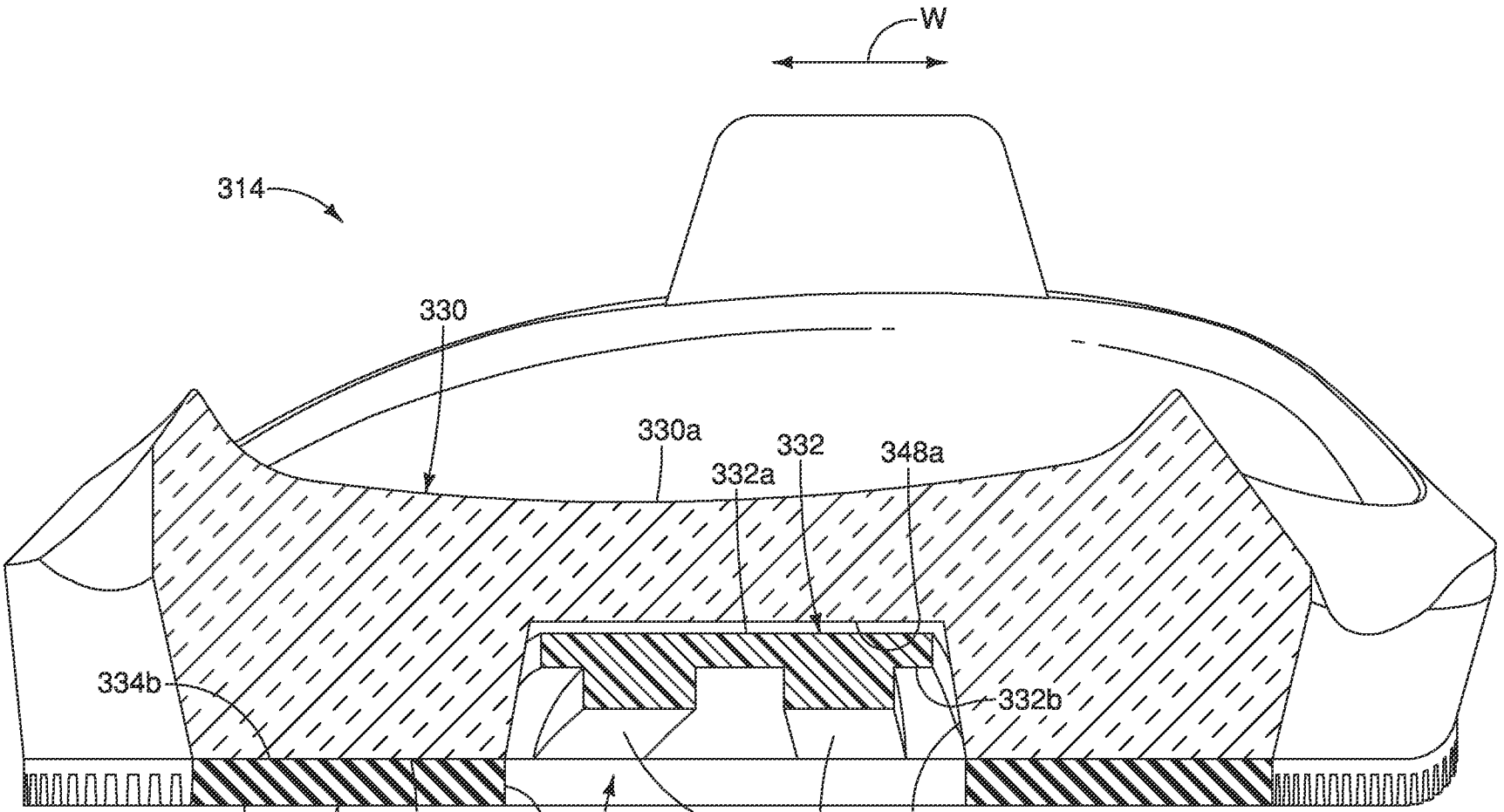
FIG. 26 is a widthwise cross sectional view, similar to FIG. 11, of the shoe sole illustrated in FIGS. 22 to 23 in a non-flex state (i.e., non-deformed state).
Figure 27:
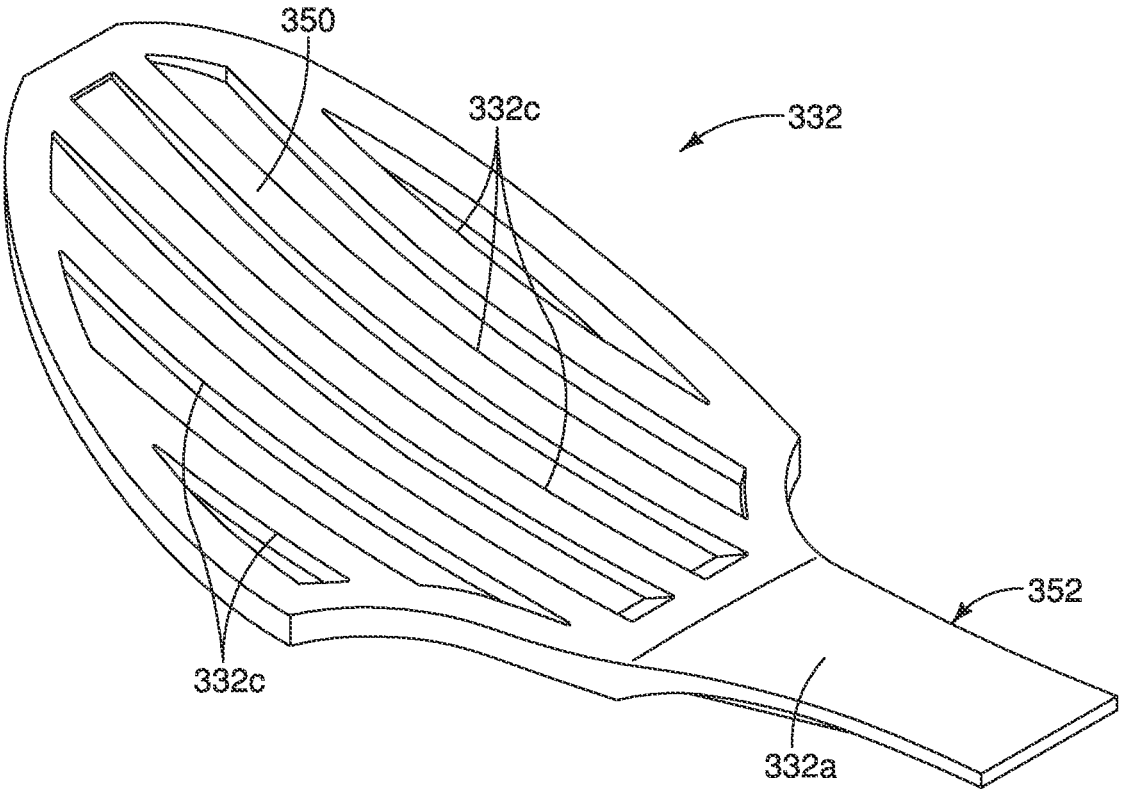
FIG. 27 is a top perspective view of the second layer of the shoe sole illustrated in FIGS. 22 to 26.
Figure 28:
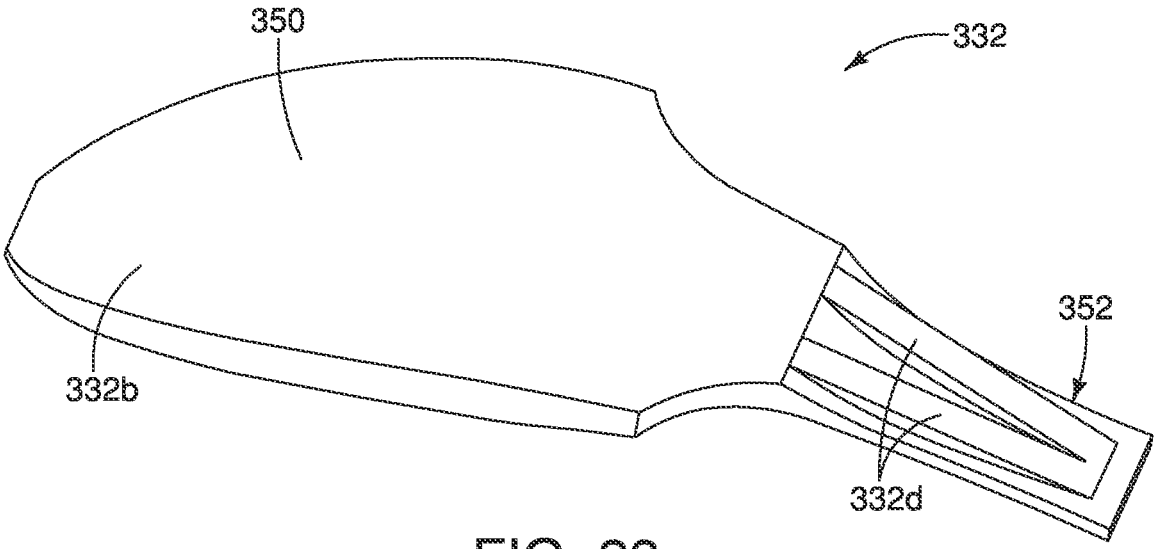
FIG. 28 is a bottom perspective view of the second layer of the shoe sole illustrated in FIG. 27.
Figure 29:
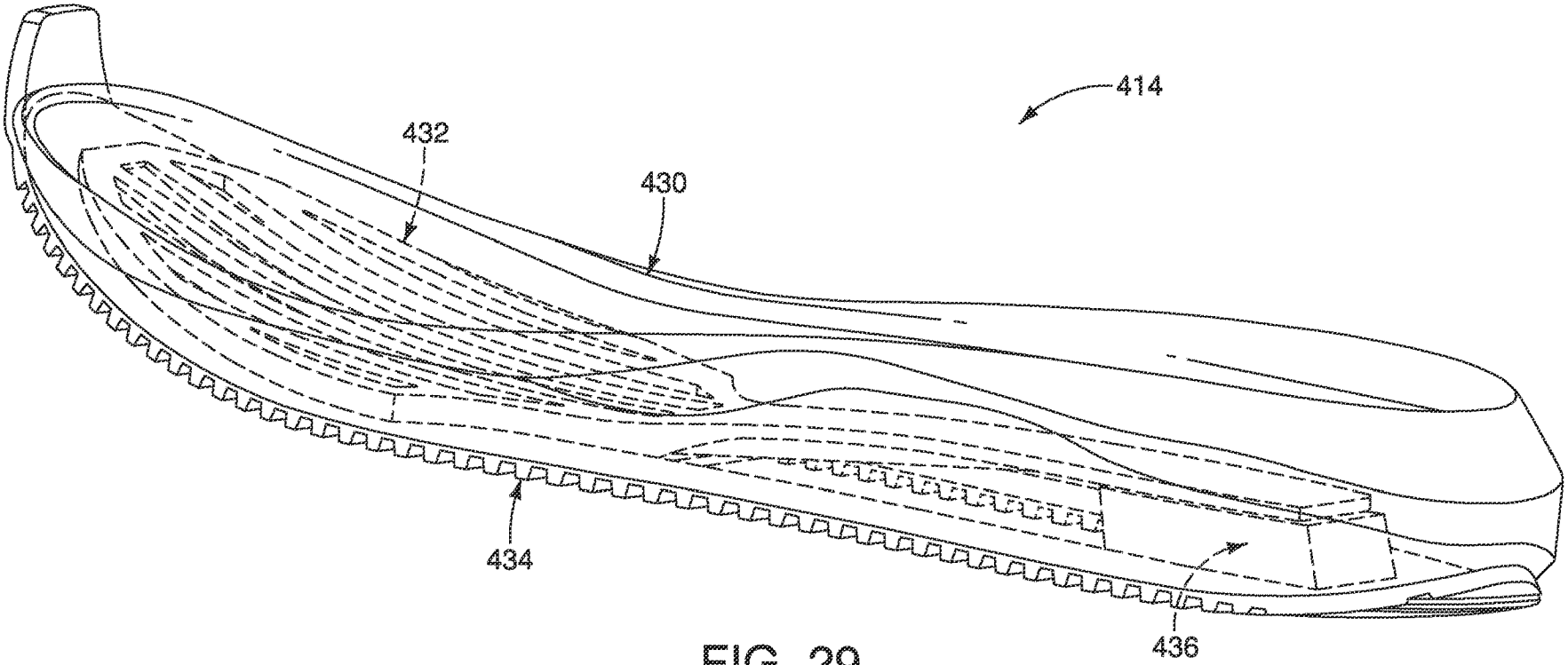
FIG. 29 is a perspective view of a shoe sole in accordance with a fifth embodiment.
Figure 30:
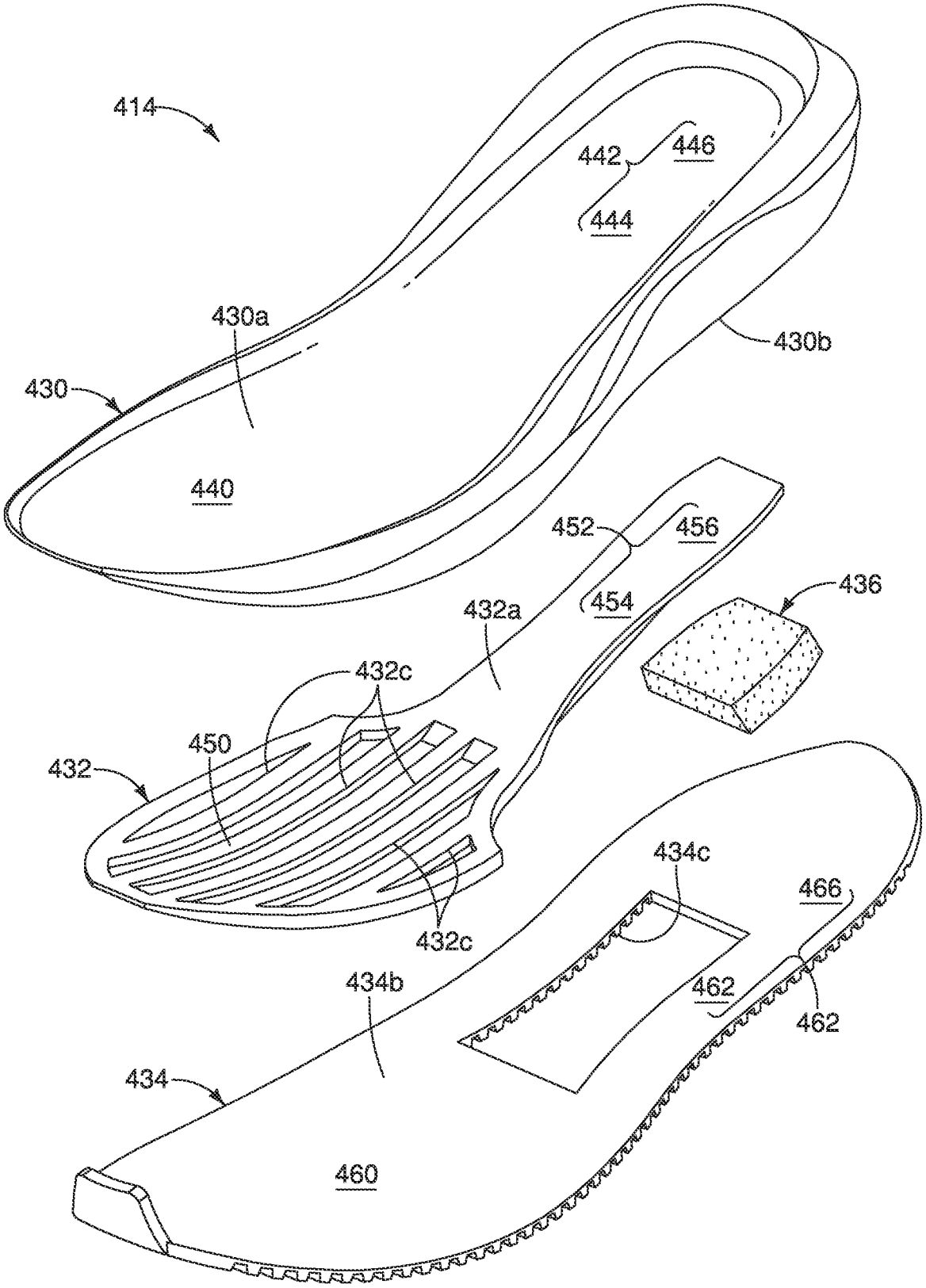
FIG. 30 is an exploded top perspective view of the shoe sole illustrated in FIG. 29.
Figure 31:
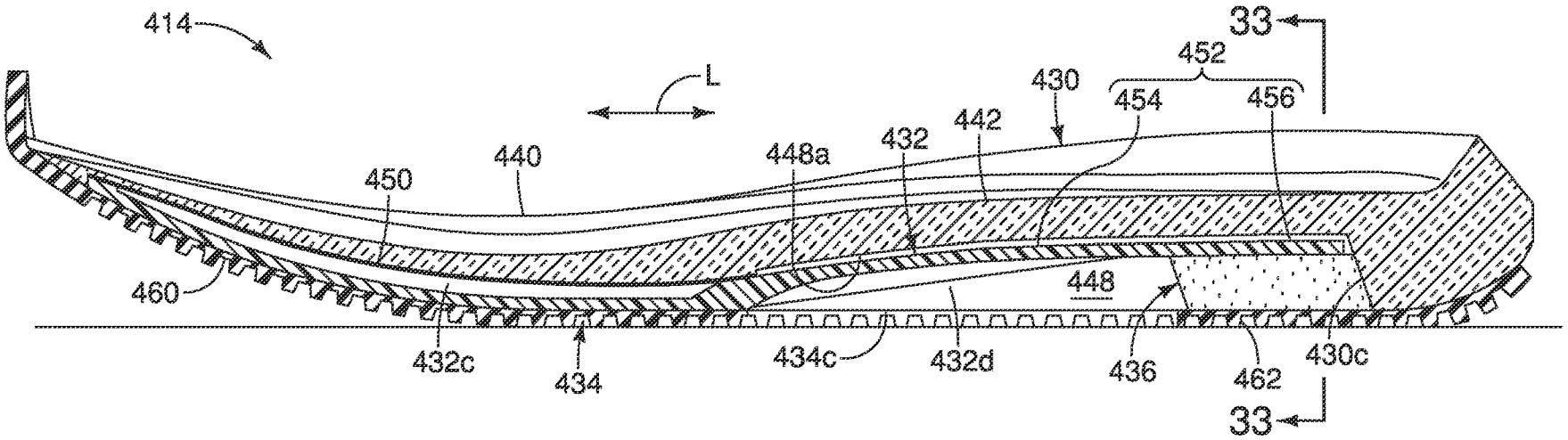
FIG. 31 is a longitudinal cross sectional view, similar to FIGS. 9, 17, 20 and 24, of the shoe sole illustrated in FIGS. 22 and 23.

Referring now to FIGS. 20 and 21, a shoe sole 214 is illustrated in accordance with a third embodiment. The shoe sole 214 is attached to the upper 12, which is discussed above, to form a shoe. The shoe sole 214 basically comprises a first layer 230, a second layer 232 and a third layer 234. In view of the similarity between the third embodiment and the prior embodiments, the descriptions of the parts of the third embodiment that are identical to the parts of the prior embodiments may be omitted for the sake of brevity.

The first layer 230 includes a forefoot part 240 and a tarsal part 242. The first layer 230 has a first surface 230*a* and a second surface 230*b* that is provided with a recess 230*c* for defining a space 248. The first layer 230 of the shoe sole 214 is made of the same material as the first layer 30 of the shoe sole 14. The first layer 230 of the shoe sole 214 is identical to the first layer 30 of the shoe sole 14, except that the recess 230*c* has been modified to provide a gap 248*a* between the first layer 230 and the second layer 232. Thus, the description of the first layer 30 applies to the first layer 230 to the extent that they are identical. Here, the gap 248*a* is preferably about two millimeters or less between the first layer 230 and the second layer 232 where the shoe sole 214 is in a non-deformed state. In the third embodiment, the gap 248*a* only extends a portion of the tarsal part 242 with respect to the longitudinal direction L. In particular, the gap 248*a* extends the rear end of the recess 230*c* to about halfway along the tarsal part 242 with respect to the longitudinal direction L.

The second layer 232 has a first surface 232*a* and a second surface 232*b*. The second layer 232 has a forefoot part 250 and a tarsal part 252 having a midfoot part 254 and a hindfoot part 256. The second layer 232 includes a plurality of first protrusions 232*c* and a plurality of second protrusions 232*d*. The second layer 232 of the shoe sole 214 is made of the same material as the second layer 32 of the shoe sole 14. The second layer 232 of the shoe sole 214 is identical to the second layer 32 of the shoe sole 14. Thus, the description of the second layer 32 applies to the second layer 232. However, due to the addition of the gap 248*a*, a rear portion of the tarsal part 252 of the second layer 232 does not contact the first layer 230 where the shoe sole 214 is in a non-deformed state.

The third layer 234 includes a forefoot part 260 and a tarsal part 262. The third layer 234 has a ground contact surface 234*a* and an attachment surface 234*b*. The third layer 234 of the shoe sole 214 is made of the same material as the third layer 34 of the shoe sole 14. The third layer 234 of the shoe sole 214 is identical to the third layer 34 of the shoe sole 14. Thus, the description of the third layer 34 applies to the third layer 234.

Referring now to FIGS. 22 to 27, a shoe sole 314 is illustrated in accordance with a fourth embodiment. The shoe sole 314 is attached to the upper 12, which is discussed above, to form a shoe. The shoe sole 314 basically comprises a first layer 330, a second layer 332 and a third layer 334. In view of the similarity between the fourth embodiment and the prior embodiments, the descriptions of the parts of the fourth embodiment that are identical to the parts of the prior embodiments may be omitted for the sake of brevity.

The first layer 330 includes a forefoot part 340 and a tarsal part 342. The first layer 330 has a first surface 330*a* and a second surface 330*b* that is provided with a recess 330*c* for defining a space 348. The first layer 330 of the shoe sole 314 is made of the same material as the first layer 30 of the shoe sole 14. The first layer 330 of the shoe sole 314 is identical to the first layer 30 of the shoe sole 14, except that the recess 330*c* has been modified to provide a gap 348*a* between the first layer 330 and the second layer 332 and the longitudinal length of the recess 330*c* is shorter than the recess 30*c*. Thus, the description of the first layer 30 applies to the first layer 330 to the extent that they are identical. Here, the gap 348*a* is preferably about two millimeters or less between the first layer 330 and the second layer 332 where the shoe sole 314 is in a non-deformed state. In the fourth embodiment, the gap 348*a* extends the entire length or substantially the entire length of the tarsal part 342 with respect to the longitudinal direction L.

The second layer 332 has a first surface 332*a* and a second surface 332*b*. The second layer 332 has a forefoot part 350 and a tarsal part 352. In the fourth embodiment, the tarsal part 352 is shorter than the prior embodiments. Specifically, the tarsal part 352 only extends along a midfoot part of the shoe sole 314 with respect to the longitudinal direction L. The second layer 332 includes a plurality of first protrusions 332*c* and a plurality of second protrusions 332*d*. The second layer 332 of the shoe sole 314 is made of the same material as the second layer 32 of the shoe sole 14. The second layer 332 of the shoe sole 314 is identical to the second layer 32 of the shoe sole 14, except that the tarsal part 352 is shorter than the tarsal part 52 with respect to the longitudinal direction L. Thus, the description of the second layer 32 applies to the second layer 332 to the extent that they are identical. Similar to the second embodiment, due to the addition of the gap 348*a*, the tarsal part 352 of the second layer 332 does not contact the first layer 330 where the shoe sole 314 is in a non-deformed state.

The third layer 334 includes a forefoot part 360 and a tarsal part 362. The third layer 334 has a ground contact surface 334*a* and an attachment surface 334*b*. The third layer 334 of the shoe sole 314 is made of the same material as the third layer 34 of the shoe sole 14. The third layer 334 of the shoe sole 314 is identical to the third layer 34 of the shoe sole 14, except that the opening 334*c* is shorter with respect to the longitudinal direction L. Thus, the description of the third layer 34 applies to the third layer 334 to the extent that they are identical.

Referring now to FIGS. 29 to 33, a shoe sole 414 is illustrated in accordance with a fifth embodiment. The shoe sole 414 is attached to the upper 12, which is discussed above, to form a shoe. The shoe sole 414 basically comprises a first layer 430, a second layer 432 and a third layer 434. In view of the similarity between the fifth embodiment and the prior embodiments, the descriptions of the parts of the fourth embodiment that are identical to the parts of the prior embodiments may be omitted for the sake of brevity.

Here, the shoe sole 414 further comprises a deformable part 436 that is disposed between the second layer 432 and the third layer 434. The deformable part 436 is preferably made of a compressible foam material such as ethylene-vinyl acetate foam. The deformable part 436 has a lower hardness than the material of the first layer 430.

The first layer 430 includes a forefoot part 340 and a tarsal part 442. The first layer 430 has a first surface 430*a* and a second surface 430*b* that is provided with a recess 430*c* for defining a space 448. The first layer 430 of the shoe sole 414 is made of the same material as the first layer 30 of the shoe sole 14. The first layer 430 of the shoe sole 414 is identical to the first layer 30 of the shoe sole 14, except that the recess 430*c* has been modified to provide a gap 448*a* between the first layer 430 and the second layer 432. Thus, the description of the first layer 30 applies to the first layer 430 to the extent that they are identical. Here, the gap 448*a* is preferably about two millimeters or less between the first layer 430 and the second layer 432 where the shoe sole 414 is in a non-deformed state. In the fifth embodiment, the gap 448*a* extends the entire length or substantially the entire length of the tarsal part 442 with respect to the longitudinal direction L.

The second layer 432 has a first surface 432*a* and a second surface 432*b*. The second layer 432 has a forefoot part 450 and a tarsal part 452. The second layer 432 includes a plurality of first protrusions 432*c* and a plurality of second protrusions 432*d*. The second layer 432 of the shoe sole 414 is made of the same material as the second layer 32 of the shoe sole 14. The second layer 432 of the shoe sole 414 is identical to the second layer 32 of the shoe sole 14. Thus, the description of the second layer 32 applies to the second layer 432. Similar to the second embodiment, due to the addition of the gap 448*a*, the tarsal part 352 of the second layer 432 does not contact the first layer 430 where the shoe sole 414 is in a non-deformed state.

The third layer 434 includes a forefoot part 460 and a tarsal part 462. The third layer 434 has a ground contact surface 434*a* and an attachment surface 434*b*. The third layer 434 of the shoe sole 414 is made of the same material as the third layer 34 of the shoe sole 14. The third layer 434 of the shoe sole 414 is identical to the third layer 34 of the shoe sole 14, except that the opening 434*c* is shorter with respect to the longitudinal direction L. Thus, the description of the third layer 34 applies to the third layer 434 to the extent that they are identical.

Figure 32:
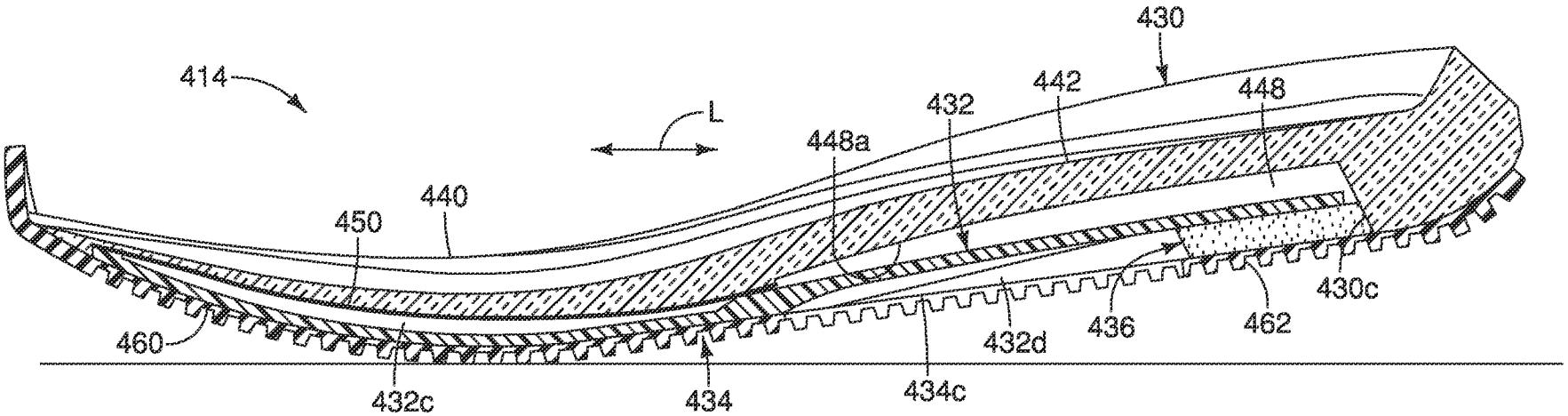
FIG. 32 is a longitudinal cross sectional view of the shoe sole illustrated in FIG. 31 but in which the shoe sole has been flexed.
Figure 33:
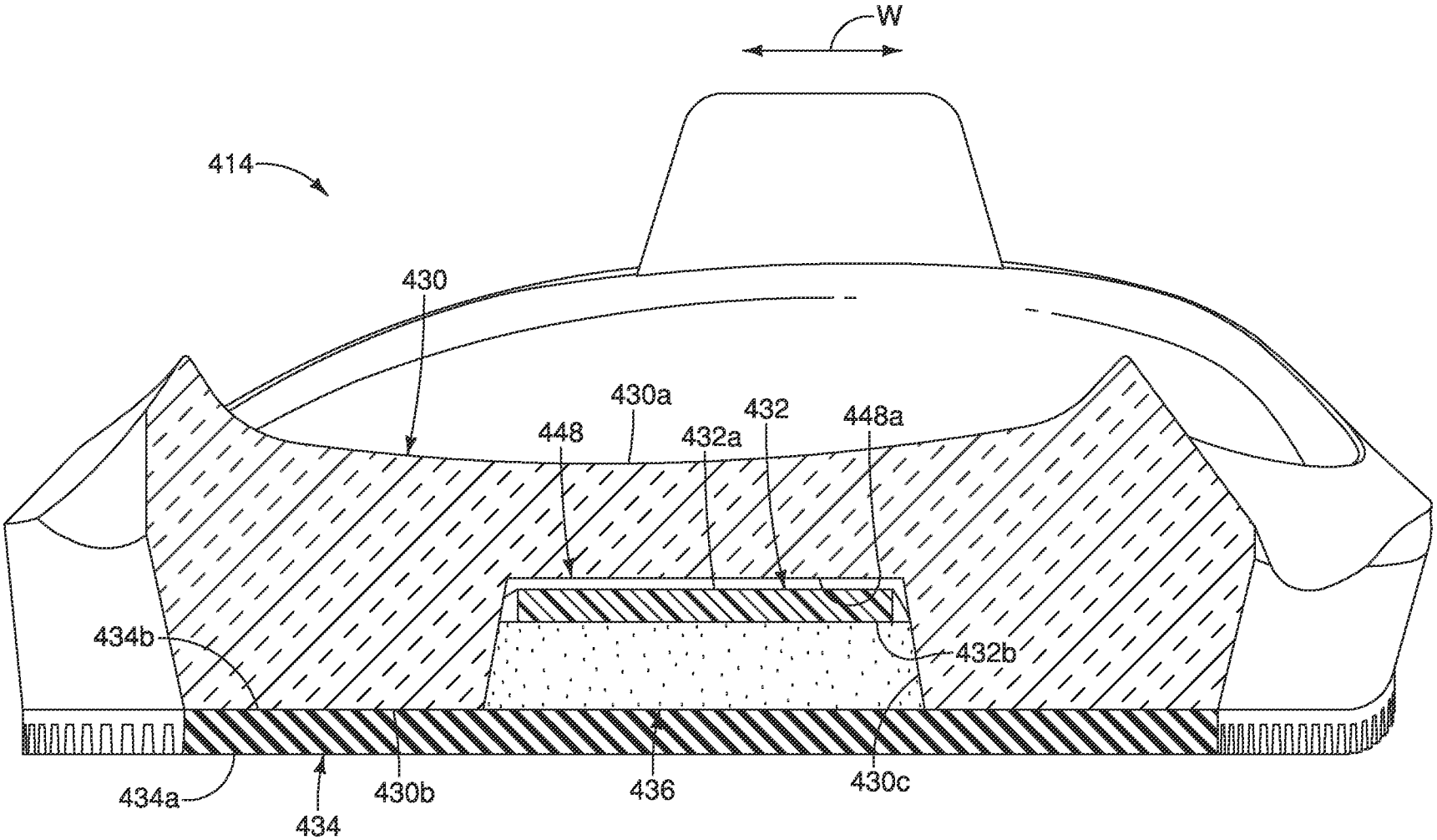
FIG. 33 is a widthwise cross sectional view of the shoe sole illustrated in FIGS. 29 to 32 taken along section line 33-33 of FIG. 31 in a non-flex state (i.e., non-deformed state).

The deformable part 436 is positioned in the space 448 between the tarsal part 452 of the second layer 432 and the tarsal part 462 of the third layer 434. Thus, as seen in FIG. 32, the deformable part 436 is compressed between the second layer 432 and the third layer 434 in a state where the shoe sole 414 is flexed. In this way, the flexibility of the shoe sole 414 can be regulated by the hardness or compressibility of the deformable part 436. Here, the deformable part 436 is bonded to one or both of the second layer 432 and the third layer 434. Alternatively, the deformable part 436 can be removable such that the shoe sole 414 can be used without the deformable part 436 or another deformable part 436 having a different levels of hardness and/or compressibility can be used. In this way, the user can adjust the flexibility of the shoe sole 414 by exchanging deformable parts having different levels of hardness and/or compressibility, or by omitting the deformable part 436.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts unless otherwise stated.

As used herein, the following directional terms "frame facing side", "non-frame facing side", "forward", "rearward", "front", "rear", "up", "down", "above", "below", "upward", "downward", "top", "bottom", "side", "vertical", "horizontal", "perpendicular" and "transverse" as well as any other similar directional terms refer to those directions of a shoe in an upright position on level ground. Accordingly, these directional terms, as utilized to describe the shoe sole should be interpreted relative to a shoe in an upright riding position on a horizontal surface and that is equipped with the shoe sole. The terms "left" and "right" are used to indicate the "right" when referencing from the right side as viewed from a person wearing the shoe, and the "left" when referencing from the left side as viewed from a person wearing the shoe.

The phrase "at least one of" as used in this disclosure means "one or more" of a desired choice. For one example, the phrase "at least one of" as used in this disclosure means "only one single choice" or "both of two choices" if the number of its choices is two. For another example, the phrase "at least one of" as used in this disclosure means "only one single choice" or "any combination of equal to or more than two choices" if the number of its choices is equal to or more than three. Also, the term "and/or" as used in this disclosure means "either one or both of". For instance, the phrase "at least one of A and B" encompasses (1) A alone, (2), B alone, and (3) both A and B. The phrase "at least one of A, B, and C" encompasses (1) A alone, (2), B alone, (3) C alone, (4) both A and B, (5) both B and C, (6) both A and C, and (7) all A, B, and C. In other words, the phrase "at least one of A and B" does not mean "at least one of A and at least one of B" in this disclosure.

Also, it will be understood that although the terms "first" and "second" may be used herein to describe various components, these components should not be limited by these terms. These terms are only used to distinguish one component from another. Thus, for example, a first component discussed above could be termed a second component and vice versa without departing from the teachings of the present invention.

The term "attached" or "attaching", as used herein, encompasses configurations in which an element is directly secured to another element by affixing the element directly to the other element; configurations in which the element is indirectly secured to the other element by affixing the element to the intermediate member(s) which in turn are affixed to the other element; and configurations in which one element is integral with another element, i.e. one element is essentially part of the other element. This definition also applies to words of similar meaning, for example, "joined", "connected", "coupled", "mounted", "bonded", "fixed" and their derivatives. Finally, terms of degree such as "substantially", "about" and "approximately" as used herein mean an amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, unless specifically stated otherwise, the size, shape, location or orientation of the various components can be changed as needed and/or desired so long as the changes do not substantially affect their intended function. Unless specifically stated otherwise, components that are shown directly connected or contacting each other can have intermediate structures disposed between them so long as the changes do not substantially affect their intended function. The functions of one element can be performed by two, and vice versa unless specifically stated otherwise. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A shoe sole comprising:

a first layer that is a one-piece member; and a second layer having a forefoot part and a tarsal part, the forefoot part of the second layer extending along the first layer such that the forefoot part of the second layer is coupled to the first layer, the first layer including a space defined by a recess formed in the first layer, and the tarsal part of the second layer being configured to be received in the space and displaceable relative to the first layer into the space in a state where the first layer is flexed.

2. The shoe sole according to claim 1, wherein the second layer is more rigid than the first layer.

3. The shoe sole according to claim 1, wherein the second layer has a longitudinal direction extending between the forefoot part and the tarsal part, and a width direction perpendicular to the longitudinal direction, and the second forefoot part is wider than the second tarsal part in the width direction.

4. The shoe sole according to claim 1, wherein the second layer has a longitudinal direction extending between the forefoot part and the tarsal part, and the second layer is shorter than the first layer in the longitudinal direction.

5. The shoe sole according to claim 1, further comprising a third layer coupled to the forefoot part and having a ground contact surface.

6. The shoe sole according to claim 1, wherein the first layer includes a foam material.

7. The shoe sole according to claim 6, wherein the foam material includes an ethylene-vinyl acetate foam.

8. The shoe sole according to claim 6, wherein the foam material includes a polyurethane foam.

9. The shoe sole according to claim 1, wherein the second layer includes a resin material.

10. The shoe sole according to claim 9, wherein the resin material includes a polyamide material.

11. The shoe sole according to claim 9, wherein the resin material includes a fiber material.

12. The shoe sole according to claim 11, wherein the fiber material includes a plurality of carbon fibers.

13. The shoe sole according to claim 11, wherein the fiber material includes a plurality of glass fibers.

14. The shoe sole according to claim 1, wherein the second layer includes at least one first protrusion disposed on one of the forefoot part and the tarsal part.

15. The shoe sole according to claim 14, wherein the second layer includes at least one second protrusion disposed on the other one of the forefoot part and the tarsal part.

16. The shoe sole according to claim 15, wherein the second layer has a longitudinal direction extending between the forefoot part and the tarsal part, and the first protrusion and the second protrusion extend in the longitudinal direction.

17. A shoe comprising:

the shoe sole according to claim 1, and further comprising an upper coupled to the shoe sole.

* * * * *